US006215451B1

(12) United States Patent
Hadzoglou

(10) Patent No.: US 6,215,451 B1
(45) **Date of Patent: *Apr. 10, 2001**

(54) DUAL-BAND GLASS-MOUNTED ANTENNA

(75) Inventor: James Hadzoglou, Mayfield Heights, OH (US)

(73) Assignee: Allen Telecom Inc., Beachwood, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/971,369

(22) Filed: Nov. 17, 1997

(51) Int. Cl.[7] ..... H01Q 1/32

(52) U.S. Cl. ..... 343/715; 343/702; 343/713; 343/715

(58) Field of Search ..... 343/715, 713, 343/702

(56) References Cited

U.S. PATENT DOCUMENTS

| | | | | |
|---|---|---|---|---|
| 4,238,799 | | 12/1980 | Parfitt | 343/715 |
| 4,675,687 | * | 6/1987 | Elliott | 343/715 |
| 4,764,773 | | 8/1988 | Larsen et al. | 343/713 |
| 4,794,319 | | 12/1988 | Shimazaki | 343/715 |
| 4,839,660 | | 6/1989 | Hadzoglou | 343/715 |
| 4,857,939 | | 8/1989 | Shimazaki | 343/715 |
| 4,860,019 | * | 8/1989 | Jiang et al. | 343/795 |
| 5,181,043 | | 1/1993 | Cooper | 343/713 |
| 5,298,907 | | 3/1994 | Klein | 343/715 |
| 5,451,966 | | 9/1995 | Du et al. | 343/715 |
| 5,471,222 | | 11/1995 | Du | 343/713 |
| 5,565,877 | * | 10/1996 | Du et al. | 343/715 |
| 5,734,355 | * | 3/1998 | Watanabe | 343/859 |
| 5,742,255 | * | 4/1998 | Afendras | 343/713 |

* cited by examiner

*Primary Examiner*—Don Wong
*Assistant Examiner*—Shih-Chao Chen
(74) *Attorney, Agent, or Firm*—Laff, Whitesel & Saret, Ltd.

(57) ABSTRACT

A dual-band glass-mounted antenna system includes a dual-band through-the-glass coupler, a matching section, and a dual-band collinear antenna element. The coupler has a portion which is secured to an interior surface of the glass, and a portion which is secured to the exterior surface of the glass at a position opposite the interior portion. Co-planer transmission line circuitry in the interior and exterior portions of the coupler cooperatively form a four-conductor transmission line operating in the "coupled microstrip line odd mode," thereby achieving coupling of RF energy through the glass window material in two disparate frequency bands. The transmission line characteristics are selected to achieve efficient coupling and desired impedance characteristics in the cellular and PCS frequency bands. The dual-band antenna element includes upper and lower radiator sections separated by a phasing coil. A sleeve choke assembly positioned at an intermediate location in the upper radiator section is on the order of one quarter wavelength at PCS frequencies. At PCS frequencies, the choke virtually eliminates current flow beyond the base of the choke, effectively establishing a half-wave radiating section between the top of the phasing coil and the base of the choke. At cellular frequencies, the choke has little effect, and therefore the entire upper radiator section acts as a half-wave radiator. The phasing coil advantageously achieves broadband, "in-phase" radiation conditions between the upper and lower collinear radiator sections at both cellular and PCS frequencies.

50 Claims, 17 Drawing Sheets

FIG. 26

TABLE SHOWING OF COUPLER WITH A 50 OHM LOAD.

| FREQ. IN MHZ | RIN | XIN | VSWR |
|---|---|---|---|
| 750 | 0.90 | 0.29 | 1.38 |
| 800 | 0.95 | 0.31 | 1.38 |
| 850 | 1.00 | 0.34 | 1.39 |
| 900 | 1.08 | 0.37 | 1.43 |
| 950 | 1.19 | 0.43 | 1.54 |
| 1000 | 1.43 | 0.55 | 1.78 |
| 1050 | 2.07 | 0.67 | 2.34 |
| 1100 | 3.69 | -0.56 | 3.78 |
| 1150 | 1.28 | -2.75 | 7.81 |
| 1200 | 0.19 | -1.63 | 19.05 |
| 1250 | 0.05 | -1.04 | 41.26 |
| 1300 | 0.03 | -0.72 | 54.89 |
| 1350 | 0.03 | -0.49 | 41.19 |
| 1400 | 0.05 | -0.30 | 22.81 |
| 1450 | 0.09 | -0.13 | 11.93 |
| 1500 | 0.15 | 0.02 | 6.57 |
| 1550 | 0.26 | 0.17 | 3.93 |
| 1600 | 0.42 | 0.27 | 2.57 |
| 1650 | 0.63 | 0.31 | 1.81 |
| 1700 | 0.84 | 0.24 | 1.36 |
| 1750 | 0.98 | 0.07 | 1.08 |
| 1800 | 1.00 | -0.11 | 1.12 |
| 1850 | 0.95 | -0.25 | 1.30 |
| 1900 | 0.87 | -0.32 | 1.45 |
| 1950 | 0.80 | -0.32 | 1.52 |
| 2000 | 0.81 | -0.22 | 1.38 |
| 2050 | 2.17 | 0.52 | 2.33 |

454

FIG. 27

TABLE SHOWING PAIRS OF VALUES FOR XA AND XB FOR IMPEDANCE MATCHING.

| FREQ. IN MHZ | RIN | XIN | VSWR |
|---|---|---|---|
| 750 | 278.10 | -0.93 | 1.38 |
| 800 | 580.84 | 3.83 | 1.38 |
| 850 | -6857.55 | 8.72 | 1.39 |
| 900 | -487.57 | 14.05 | 1.43 |
| 950 | -247.17 | 20.15 | 1.54 |
| 1000 | -161.35 | 27.48 | 1.78 |
| 1050 | -116.26 | 36.67 | 2.34 |
| 1100 | -87.68 | 48.47 | 3.78 |
| 1150 | -67.30 | 63.18 | 7.81 |
| 1200 | -51.46 | 78.17 | 19.05 |
| 1250 | -38.24 | 81.95 | 41.26 |
| 1300 | -26.50 | 60.56 | 54.89 |
| 1350 | -15.42 | 27.67 | 41.19 |
| 1400 | -4.32 | 5.14 | 22.81 |
| 1450 | 7.50 | -5.59 | 11.93 |
| 1500 | 20.98 | -9.71 | 6.57 |
| 1550 | 37.57 | -10.68 | 3.93 |
| 1600 | 59.96 | -10.18 | 2.57 |
| 1650 | 94.10 | -8.99 | 1.81 |
| 1700 | 156.80 | -7.45 | 1.36 |
| 1750 | 322.53 | -5.71 | 1.08 |
| 1800 | 2514.46 | -3.80 | 1.12 |
| 1850 | -513.74 | -1.68 | 1.30 |
| 1900 | -246.23 | 0.81 | 1.45 |
| 1950 | -165.83 | 4.14 | 1.52 |
| 2000 | -126.40 | 10.10 | 1.38 |
| 2050 | -102.57 | 37.27 | 2.33 |

456

FIG. 28

```
10 ' PROGRAM TO EVALUATE PERFORMANCE OF ANTENNA COUPLER, DIELECTRIC CONSTANT
OF GLASS =7'
20 DIM F(80), RIN(80), XIN(80),G(80),VS(80),XA(80),XB(80),X1(80),X4(80),
    X3(80),XB1(80),XB3(80),XB4(80),XB5(80)
30 ' DEFINE FREQUENCY VARIABLE NORMALIZED TO 900 MHZ., 25 MHZ STEPS.'
40 FOR N=1 TO 60
50 F(N)=(7.25+N/4)/9
60 ' TRANSMISSION LINE LENGTHS IN REDIANS. UA1,UA12,UA2 ARE FOR COUPLED COPLANAR
LINE MODE FOR 1" , 5/16" , AND 1/38" LONG SECTIONS. UB1, UB12, UB2 ARE FOR
COUPLED MICROSTRIP LINE ODD MODE.'
70 UA1=.94*F(N):UA12=.26*F(N):UA2=.9*F(N)
80 UB1=1.5*F(N):UB12=34*F(N):UB2=1.64*F(N)
90 ' XC IS SHUNT REACTANCE AT STEP IN SLOT WIDTH.'
100 XC=-800/F(N)
110 ' X1,X2,X3,X4, XB1,XB2,XB3,XB4,XB5 ARE REACTANCES USED AS INTERMEDIATE STEPS
TO FIND XA AND XB.'
120 X1(N)=91*TAN(UA1)
130 X2=-280/TAN(UA2)
140 X3(N)=XC*X2/(XC+X2)
150 X4(N)=91*(X3(N)+91*TAN(UA12))/(91-X3(N)*TAN(UA12))
160 XA(N)=X1(N)*X4(N)//X1(N)+X4(N))
170 XB1(N)=31*TAN(UB1)
180 XB2=-49/TAN(UB2)
190 XB3(N)=XC*XB2/(XC+XB2)
200 XB4(N)=31*(XB3(N)+31*TAN(UB12))/(31-XB3(N)*TAN(UB12))
210 XB5(N)=XB1(N)*XB4(N)/(XB1(N)+XB4(N))
220 XB(N)=XA(N)*XB5(N)/(XA(N)-XB5(N))
230 ' D IS DENOMINATOR FOR ZIN WITH 50 OHM LOAD AT OUTPUT OF COUPLER.'
240 ' RIN, XIN ARE NORMALIZED INPUT RESISTANCE AND REACTANCE FOR COUPLER.
G(N)= MAGNITUDE OF REFLECTION COEFFICIENT. VS(N)= VSWR.'
250 D=(2*XB(N)+XA(N))^2+10000*(1+XB(N)/XA(N))^2
260 RIN(N)=(2*XB(N)+XA(N))^2-XA(N)*XB(N)*4*(1+XB(N)/XA(N))
270 RIN(N)=RIN(N)/D
280 XIN(N)=(200*XB(N)+100*XA(N))*(1+XB(N)/XA(N))+XA(N)*XB(N)*(2*XB(N)+XA(N))/25
290 XIN(N)=XIN(N)/D
300 G(N)=SQR(((RIN(N)-1)^2+XIN(N)^2)/((RIN(N)+1)^2+XIN(N)^2))
310 VS(N)=(1+G(N))/(1-G(N)
320 NEXT N
330 PRINT " FREQ.IN MHZ." ," RIN" ,"   XIN" ,"   VSWR" :PRINT" ____________________
_____________________________"
340 FOR N=1 TO 54 STEP 2
350 PRINT USING " ####" ;F(N)*900,:PRINT USING " ###########.##" ;RIN(N),XIN(N),VS(N)
360 NEXT N
```

460

FIG. 29
TABLE SHOWING OF COUPLER WITH A 50 OHM LOAD.
(ONE TRANSMISSION LINE LENGTH CHANGED TO 65 RADIANS AT 900 MHZ.)
| FREQ. IN MHZ | RIN | XIN | VSWR |
|---|---|---|---|
| 750 | 0.92 | 0.25 | 1.31 |
| 800 | 0.97 | 0.26 | 1.30 |
| 850 | 1.02 | 0.26 | 1.29 |
| 900 | 1.08 | 0.26 | 1.30 |
| 950 | 1.17 | 0.29 | 1.36 |
| 1000 | 1.36 | 0.34 | 1.52 |
| 1050 | 1.83 | 0.31 | 1.91 |
| 1100 | 2.63 | -0.67 | 2.83 |
| 1150 | 1.20 | -1.94 | 4.96 |
| 1200 | 0.31 | -1.28 | 8.78 |
| 1250 | 0.14 | -0.80 | 11.92 |
| 1300 | 0.11 | -0.49 | 10.97 |
| 1350 | 0.14 | -0.26 | 7.70 |
| 1400 | 0.20 | -0.07 | 4.93 |
| 1450 | 0.31 | 0.09 | 3.20 |
| 1500 | 0.48 | 0.20 | 2.20 |
| 1550 | 0.68 | 0.23 | 1.61 |
| 1600 | 0.87 | 0.16 | 1.24 |
| 1650 | 1.00 | 0.00 | 1.00 |
| 1700 | 1.02 | -0.18 | 1.19 |
| 1750 | 0.97 | -0.32 | 1.39 |
| 1800 | 0.88 | -0.41 | 1.57 |
| 1850 | 0.79 | -0.45 | 1.73 |
| 1900 | 0.71 | -0.44 | 1.86 |
| 1950 | 0.66 | -0.39 | 1.88 |
| 2000 | 0.68 | -0.28 | 1.66 |
| 2050 | 1.93 | 0.25 | 1.97 |
480
FIG. 30a
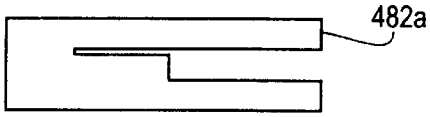
FIG. 30b
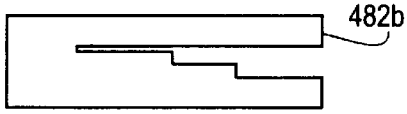
FIG. 30c
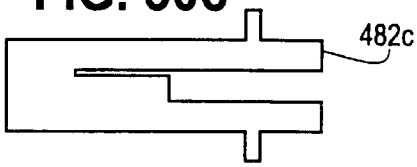
FIG. 30d
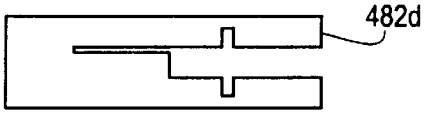
FIG. 30e
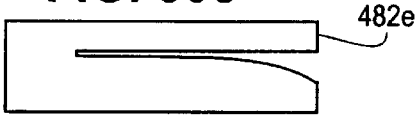

DUAL-BAND GLASS-MOUNTED ANTENNA

FIELD OF THE INVENTION

This invention relates to antenna systems for radiotelephone communications, and more particularly, to multiple-band antenna systems usable in cellular and PCS frequency ranges and adapted for coupling through and mounting upon a glass window or other planar dielectric surface.

BACKGROUND OF THE INVENTION

Recent developments in the wireless telephone communications industry have created the need for wireless subscriber terminals (or "wireless telephones") capable of operating in two widely displaced frequency ranges. In the United States, the frequency range from approximately 824 to 894 MHz (with some gaps) has been allocated for conventional "cellular" radio telephone service, and the frequency range from approximately 1850 to 1990 MHz has been allocated for a new "Personal Communications System" (PCS) service. Cellular systems, some of which have been in commercial operation since 1984, are relatively mature. Cellular systems provide "blanket" coverage throughout many metropolitan areas and geographically extensive coverage in many other areas where the population density or vehicular traffic are sufficient to warrant coverage.

PCS systems, on the other hand, are relatively new, and have a relatively small subscriber base. Some metropolitan areas do not yet have working PCS systems, and even in areas in which one or more PCS systems exist, such systems do not yet provide coverage which is as geographically extensive as that provided by mature cellular systems. As a result, a subscriber to a particular PCS system may often be in a location in which the subscriber's PCS system is not available, but a cooperative cellular system is available. This could occur, for example, when the subscriber is located within a coverage void in a "home" region generally served by the subscribed PCS system. This could also occur when the subscriber is located outside the home region, such as in a city where the subscriber's wireless service provider does not operate a PCS system.

In order to enable PCS system subscribers to obtain wireless telephone service in areas in which the subscribed PCS system is unavailable, but a cellular system is available, wireless telephone manufacturers have developed wireless telephones capable of operation in both the cellular and PCS frequency bands. For convenient reference, the term "cellular" as applied to frequencies or frequency bands is used herein to refer to the frequency bands allocated in the United States to the Domestic Public Cellular Telecommunications Radio Service (generally, 824 to 894 MHz), and to nearby frequencies, without regard to the type of service, radio protocol standards, or technology actually in use at such frequencies. The term "PCS" as applied to frequencies or frequency bands is used herein to refer to the frequency bands allocated in the United States to Broadband Personal Communications Services (generally, 1850 to 1990 MHz), and to nearby frequencies, without regard to the type of service, radio protocol standards, or technology actually in use at such frequencies.

Hand-held wireless telephones are typically equipped with a small, flexible antenna capable of operating, to some extent, in both the cellular and PCS frequency bands. Antennas of this type are very short, compared to the wavelength of the signals to be transmitted and received, and are therefore very inefficient. Such antennas may be adequate when the wireless telephone is used in a location which affords a relatively short, unobstructed RF path to the base station with which communication is desired. However, when the wireless telephone is used in other locations, a better antenna is needed.

In particular, when the wireless telephone is used inside a vehicle, the structure of the vehicle both obstructs the RF path between the telephone and the base station, and scatters a substantial amount of the RF energy which would otherwise be transmitted or received by the wireless telephone. Accordingly, it is highly desirable to connect the portable telephone to an efficient antenna located on the exterior of the vehicle. This is especially important when operating in the PCS frequency band. Radio signal propagation characteristics at PCS frequencies are significantly poorer than at cellular frequencies, and the transmitter power allowed at PCS frequencies is significantly lower than the transmitter power allowed at cellular frequencies.

A popular type of antenna used in cellular and other vehicular applications is a glass-mounted or window-mounted antenna. Such antennas generally include an external portion semi-permanently affixed to the exterior surface of a vehicle window, and an internal portion semi-permanently affixed to an interior surface of the vehicle window at a position opposite the exterior portion. The interior portion is electrically connected to a suitable transmission line cable which, in turn, may be connected to the mobile telephone transceiver. The internal portion is electrically coupled to the external portion through the glass separating the two portions. The interior portion may incorporate a circuit for matching the impedance of the antenna to the impedance of the transmission line cable and for controlling the impedance of the coupling through the glass. In addition, the interior portion (or an element thereof) may function as a counterpoise.

Glass-mounted antennas are preferred in many applications because installing the antenna does not require drilling holes in an exterior vehicle surface for use in mounting the antenna and for passing a transmission line cable. This avoids problems with leakage of air and water into the vehicle, and allows the antenna to be removed from the vehicle without sealing or repairing the holes. Although temporarily installed antennas are available, they are visually obtrusive and require the transmission line cable to be passed through an existing door or window opening. As a result, the transmission line cables are often damaged.

A glass-mounted antenna generally as described above, for use at frequencies below those used in cellular and PCS communications, is disclosed in Parfitt U.S. Pat. No. 4,238,799, which is assigned to the assignee of the present application. Glass-mounted antennas for use at cellular frequencies are disclosed in Hadzoglou U.S. Pat. No. 4,839,660, which is assigned to the assignee of the present application, and in Larsen U.S. Pat. No. 4,764,773. It is believed that in each of these antennas, the mechanism by which coupling is achieved through the glass is primarily capacitive. Each of these antennas is designed to operate over a reasonably wide, but nonetheless limited, range of frequencies surrounding an optimum operating frequency. For example, the cellular antennas are disclosed as covering the entire U.S. cellular frequency band.

However, none of the antennas described in the aforementioned patents are designed specifically for operation in the PCS frequency band (1850–1900 MHz). Many existing cellular through-the-glass antennas tend to perform poorly in the PCS band due to reasons such as mismatched impedances, poor coupling through the glass, and distorted radiation characteristics. Similarly, many existing PCS antennas tend to perform poorly in the cellular band due to reasons such as mismatched impedances, poor coupling through the glass, and reduced antenna aperture.

Although there exist well-known techniques for modifying an existing antenna design to operate at a different frequency, such techniques often cannot be applied when the target operating frequency differs widely from the original operating frequency, because structures and materials may behave electrically in a fundamentally different manner. Moreover, even if the aforementioned antenna designs could be modified to operate at PCS frequencies, the bandwidths of the antennas are not sufficiently wide to allow them to be simultaneously adapted to operate satisfactorily at both cellular and PCS frequencies. Thus, a wireless subscriber using a "dual-band" wireless telephone in a vehicular application would be required to install two separate antennas on the vehicle.

Dual-band glass-mounted antennas for use in the 144–148 MHz and 440–450 MHz amateur radio bands have been mentioned in the sales literature of Tandy Corporation of Fort Worth, Tex. (e.g. Radio Shack part number 190-0324), and Larsen Electronics, Inc. of Vancouver, Wash. (e.g. Larsen model number KG 2/70). However, these antennas, and the structures they employ for coupling through the glass and for matching the antenna to the radio transceiver transmission line cable, are not suitable for use in the cellular and PCS frequency bands.

In addition, it is believed that these VHF/UHF antenna designs may exploit the serendipitous fact that the higher target operating frequency is almost exactly three times the lower target operating frequency. These antennas generally employ a radiator having upper and lower straight sections separated by a coiled section. The lengths of the straight sections and the parameters of the coiled section are selected such that the total radiator length is equivalent to a half wavelength at VHF. Because of the three-to-one ratio of frequencies, the developed length of the radiator consists of three half-wave sections at UHF. At VHF frequencies, the coil acts as a loading section, with the total radiator acting as a half-wavelength, unity-gain antenna. At UHF frequencies, the coil acts as a phasing element, creating a two element collinear radiator. Thus, this simple configuration works well for the 150 and 450 MHz bands because of the three-to-one ratio of frequencies.

This approach to constructing a dual-band antenna cannot be used successfully for the CELLULAR and PCS bands because the ratio of the frequency bands is on the order of two-to-one. The two-to-one frequency ratio tends to transform the low impedances to high impedances, and conversely high impedances to low impedances, between the two bands. This factor complicates the design of a dual-band antenna because it is generally desirable that the antenna present a consistent impedance, approximately matched to the transceiver with which it is to be used, at all operating frequencies.

Moreover, existing glass-mounted VHF/UHF dual band antennas employ through-the-glass couplers and associated matching circuitry which are designed to function only with a radiator exhibiting similar base impedances in both frequency bands. Thus, even if the wireless telephone transceiver could tolerate the widely disparate base impedances exhibited by prior-art radiators when used on frequency bands having a two-to-one ratio, these radiators could not be used with prior art through-the-glass couplers.

OBJECTS AND SUMMARY OF THE INVENTION

It is therefore an object of the present invention to provide a dual-band glass-mounted antenna system for use at disparate frequency bands above 800 MHz.

It is another object of the invention to provide a low-loss dual-band through-the-glass coupler for use at disparate frequency bands above 800 MHz.

It is a further object of the invention to provide a dual-band antenna element for mounting on a glass or other insulating surface and for use at disparate frequency bands above 800 MHz.

It is another object of the invention to provide a dual-band glass-mounted antenna system for use at cellular and PCS frequencies.

It is a further object of the invention to provide a low-loss dual-band through-the-glass coupler for use at cellular and PCS frequencies.

It is another object of the invention to provide a dual-band antenna element mounting on a glass or other insulating surface and for use at cellular and PCS frequencies.

An antenna system constructed according to the present invention comprises a two-element electrical coupling and mechanical attachment unit or coupler to be secured to a planar glass or other dielectric surface, and an antenna element electrically and mechanically coupled to the coupler. The coupler has an internal portion which is secured to an interior surface of the glass, and an external portion which is secured to the exterior surface of the glass at a position opposite the interior portion. The coupler interior portion includes a connection port for electrical connection to a transmission line cable which, in turn, may be connected to the wireless telephone transceiver.

The coupler interior portion has a substantially planar conductive sheet element which is oriented in parallel to and secured to the interior surface of the glass. The conductive sheet element incorporates a stepped slot which extends longitudinally to form two transmission line sections. The coupler exterior portion has a similarly shaped planar conductive sheet element which is secured to the exterior surface of the glass in an opposed position. The transmission line sections of the coupler interior portion and coupler exterior portion each operate in the "coupled co-planar strip line mode" on each side of the glass. In addition, the transmission line sections of the coupler interior portion and coupler exterior portion also function cooperatively to form a four-conductor transmission line operating in the "coupled microstrip line odd mode," thereby achieving coupling through the glass window material. The transmission line characteristics are selected to achieve desired impedances in the cellular and PCS frequency bands. The coupler interior portion and coupler exterior portion thus function in cooperation to provide a through-the-glass coupler which exhibits impedance characteristics within a desired range, and which exhibits minimized insertion loss, at both cellular and PCS frequencies. The coupler interior portion may also act as a counterpoise at some frequencies.

The coupler exterior portion has a connection port for electrical connection to the antenna element. The coupler exterior portion preferably includes mechanical supports for the antenna element. The coupler exterior portion may also act as a counterpoise at some frequencies and may have a counterpoise extension section extending a small distance in the transverse direction. The antenna element has a small microstrip matching section which extends, in parallel to the planar sheet, from the coupler exterior portion connection port to the base of a radiating element. The radiating element includes a mechanical support, lower radiator a phasing coil, a middle radiator, a PCS choke assembly, and an upper radiator. The PCS choke assembly exhibits a low impedance at cellular frequencies but a high impedance at PCS frequencies, thereby preventing current from flowing in the upper portion of the radiator at those frequencies. Thus, the entire radiator element acts as a collinear radiator at cellular frequencies, and the lower radiator and middle radiator function as a collinear radiator at PCS frequencies.

BRIEF DESCRIPTION OF THE DRAWINGS

These and other features of this invention will be best understood by reference to the following detailed description of a preferred embodiment of the invention, taken in conjunction with the accompanying drawings, in which:

FIG. 26 is a table showing the input resistance, input reactance, and voltage standing wave ratio, at selected frequencies, of the through-the-glass coupler as modeled according to the transmission line structures and circuits of FIGS. 18–24;

FIG. 27 is a table showing the values of several reactances and the voltage standing wave ratio, at selected frequencies, used in analyzing the through-the-glass coupler as modeled according to the transmission line structures and circuits of FIGS. 18–24, and in particular, the circuits of FIGS. 23 and 24;

FIG. 28 is a listing of a computer program which was used to produce the resistance, reactance, and VSWR values tabulated in FIGS. 26 and 27;

FIG. 29 is a modified table showing the input resistance, input reactance, and voltage standing wave ratio, at selected frequencies, of the through-the-glass coupler as modeled according to the transmission line structures and circuits of FIGS. 18–24, produced when an alternate value for the electrical length of the wide slot section is employed;

FIGS. 30(*a*)–(*e*) are exemplary alternate configurations for the transmission lines of the through-the-glass coupler;

Figure 1:
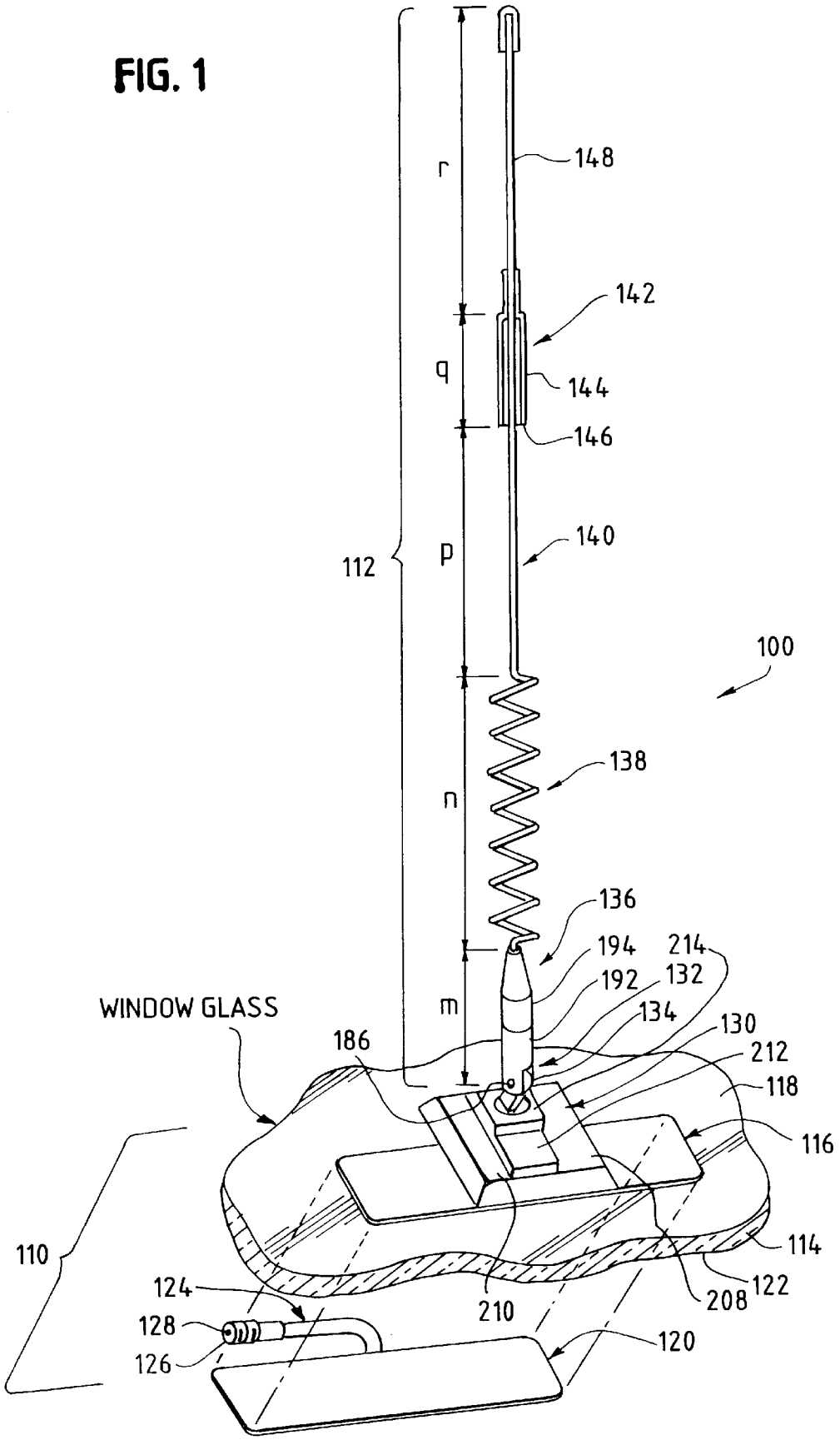
FIG. 1 is a partially exploded perspective view of an antenna system 100 constructed according to the present invention and shown in conjunction with a glass mounting surface with which the antenna system may be used.

DETAILED DESCRIPTION OF THE PREFERRED EMBODIMENT preferred embodiment of a dual-band, glass-mounted antenna system 100 constructed according to the present invention is shown generally in FIGS. 1–7. The antenna system 100 comprises a two-element electrical coupling and mechanical attachment unit or coupler 110 to be secured to a planar glass or other dielectric surface or panel 114, and a dual-band antenna/radiator element 112 which is electrically and mechanically coupled to the coupler 110. The coupler 110 has a coupler internal portion ("CIP") 120 which is secured to an interior surface 122 of the glass panel 114, and a coupler external portion ("CEP") 116 which is secured to the exterior surface 118 of the glass panel 114 at a position opposite the interior portion 120.

The coupler internal portion 120 has first and second connection points 170 and 166 (FIGS. 1–3), respectively, forming a first "port" for electrical connection to a suitable transmission line cable 124. The transmission line cable 124 may be connected to any suitable wireless telephone transceiver (not shown) which operates at cellular frequencies, PCS frequencies, or both. The coupler exterior portion 116 has first and second connection points 270 and 266 (FIGS. 4–5), respectively, forming a second port for electrical connection to dual-band antenna/radiator element 112.

As will be discussed further in greater detail, the mechanical and electrical structures forming the coupler 110 are engineered to provide an electrical coupling through the glass panel 114 between the first port and the second port. Thus, one skilled in the art will appreciate that the coupler 110 functions as a two-port, reciprocal, electrical network; this observation is useful in understanding the operation and performance of the coupler 110.

Although the dual-band, through-the-glass coupler 110 is discussed herein in the environment of a vehicular application in which the coupler's first port is connected via a cable to a wireless telephone transceiver and the second port is connected to antenna/radiator element 112, the coupler 110 may be used advantageously in other applications and with any other generators and users of RF energy. For example, the coupler 110 could be used with an antenna/radiator element other than the radiator 112 disclosed in this application. The coupler 110 could also be used in a stationary application to couple an RF signal source, such as an low-power RF exciter, to an RF signal receiver, such as a power amplifier, located on opposite sides of the glass panel 114.

Moreover, although the coupler 110 is described herein in an application in which the coupling occurs through a glass panel 114, the coupler 110 could also be used to couple through any other suitable relatively thin dielectric structure, including plastics, Fiberglas, composite materials, and the like, which need not be in a sheet configuration.

The preferred embodiment of the coupler 110 disclosed herein is engineered to provide a low-loss, controlled impedance, controlled VSWR coupling between the first and second ports over a first range of frequencies (e.g. 824 to 894 MHz) allocated in the United States to cellular telephone service, and over a second range of frequencies (e.g. 1850 to 1990 MHz) allocated in the United States to PCS communications services. The term "controlled impedance" is used is here to mean that over each of the design frequency ranges, the coupler 110 presents impedance characteristics, which, although they are not constant, do not deviate from a desired impedance by more than an acceptable amount. The term "controlled VSWR" is used here to mean that over each of the design frequency ranges, the coupler 110 presents a VSWR which remains within a desired VSWR range. As a result, the coupler 110 exhibits desirably low insertion loss and VSWR characteristics over the design frequency ranges. The performance of the coupler is discussed further in greater detail.

One of skill in the art will appreciate that although a preferred embodiment of the coupler 110 is disclosed herein with mechanical and electrical parameters selected for operation over two particular frequency ranges, the coupler design of the present invention is not limited to those particular frequencies. The mechanical and electrical parameters may be modified, without departing from the basic design of the coupler 110, to allow the coupler to operate over different frequency ranges, provided that at such frequencies, the structures of the coupler continue to perform the same electrical functions. An analysis of how the coupler functions is discussed further in greater detail.

The CIP 120 (FIGS. 1–3) is generally formed as a substantially planar, flexible conductive sheet 154 laminated between an inner insulating sheet layer or film 150 and an outer insulating sheet layer or film 156. The term "interior" is used here to denote that in a typical vehicular application, CIP 120 is installed on the surface 122 of glass panel 114 facing the vehicle interior. When installed, the inner laminating film layer 150 faces the interior surface 122 of glass panel 114. The CIP 120 may also act as a counterpoise at some frequencies.

The CIP planar conductor 154, which may act as a counterpoise, may be formed from any suitable flexible, conductive sheet material which is compatible with the inner and outer laminating film layers 150, 156. For example, the CIP planar conductor 154 may be formed from a conductive sheet, foil, or film, such as aluminum, copper, silver, and various conductive alloys, or from a composite material having a conductive component, such as thin printed circuit board material. In addition, the material from which the CIP planar conductor 154 is constructed is preferably environmentally and chemically stable, resistant to corrosion, and is adapted to permit a reliable electrical connection may be made to its surface. In a preferred embodiment of the invention, the CIP planar conductor 154 is formed from brass sheet. The thickness of the CIP planar conductor 154 may range from 0.001 in to 0.050 in. In a preferred embodiment of the invention, the CIP planar conductor 154 is 0.010 in thick.

Any suitable insulating film material may be used to form CIP inner and outer laminating film layers 150 and 156. Layers 150 and 156 provide mechanical support and for the CIP planar conductor 154, which may be fragile. In addition layers 150 and 156 protect the CIP planar conductor 154 from environmental factors, such as contaminants, which may promote corrosion or deterioration. Because the coupler is intended for use in a vehicular application, they are preferably formed from a material resistant to degradation from strong light, temperature extremes, and typical environmental contaminants, such as water, window cleaner, and the like. However, layers 150 and 156 do not contribute significantly to the electrical performance of the CIP 120, and therefore, one or more of the layers 150 and 156 may be omitted in some applications. In a preferred embodiment of the invention, the inner and outer laminating film layers 150 and 156 are formed from a polyester film material. The thickness of the inner and outer laminating film layers 150 and 156 may range from 0.005 in to 0.020 in. In a preferred embodiment of the invention, the inner and outer laminating film layers 150 and 156 are 0.005 in thick.

Figure 2:
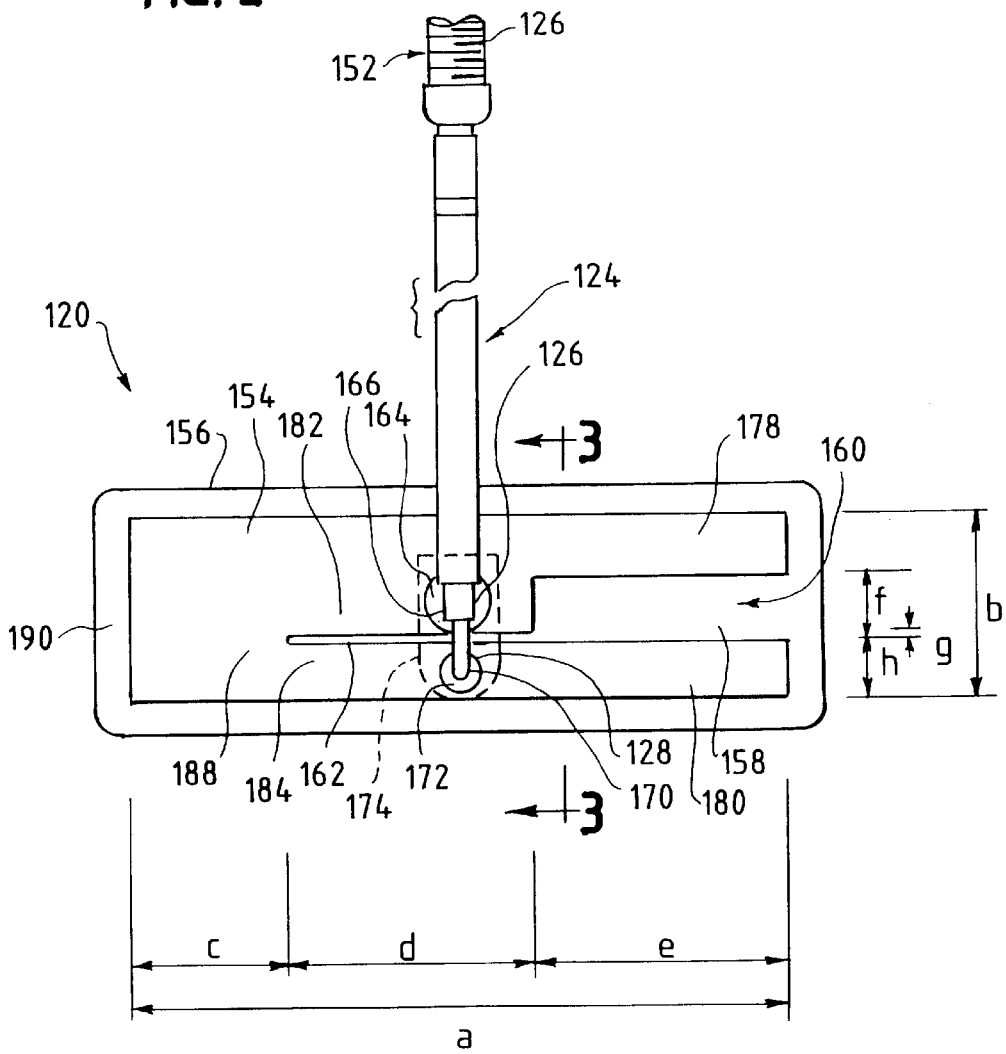
FIG. 2 is a upward-looking plan view of the interior portion of a through-the-glass coupler for use in the antenna system 100 of FIG. 1.

Assembly of the CIP inner and outer laminating film layers 150 and 156 and CIP planar conductor 154 into a laminated sheet may be performed by methods well known in the art. As best seen in FIG. 2, the inner and outer laminating film layers 150 and 156 may extend beyond the boundaries of the CIP planar conductor 154 to form an apron 190 of laminating film to provide additional structural support and avoid contamination at the edges of the CIP planar conductor 154.

An adhesive layer 176 is preferably provided on the outside surface of the inner laminating film layer 150 to secure the CIP 120 to the glass panel 114. Any suitable adhesive which is compatible with the glass panel 114 (or any other dielectric structure to which the coupler is applied), and the CIP inner laminating film layer 150, may be used. Preferably, the adhesive is a thin pressure sensitive adhesive which may be applied to the inner laminating film layer 150 during manufacture of the coupler, thereby facilitating application of the CIP 120 to the glass panel 114. For example, a suitable adhesive is available from the 3M Company under the designation SCOTCH VHB 15-mil Foam Tape. However, other adhesives, such as various glues or cement, could also be used. Alternatively, the inner laminating film layer 150 could be thermally bonded to the interior surface 122 of glass panel 114.

The CIP planar conductor 154 is preferably shaped as a generally rectangular sheet having a longitudinally-extending stepped-width slot 160 formed therein. A first electrical connection point 170 is provided on a first side of the slot 160, and a second electrical connection point 166 is provided on the opposite side of the slot 160. The electrical connection points 170 and 166 form a first connection port for the coupler 110.

Figure 3:
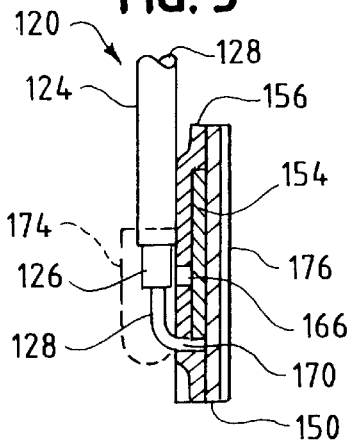
FIG. 3 is a side cross-section view of the interior portion of the through-the-glass coupler of FIG. 2, taken along the view lines 3—3 thereof.

A suitable transmission line cable 124 is preferably electrically and mechanically connected to the CIP planar conductor 154 at the connection points 170 and 166. For example, as best seen in FIGS. 2–3, a coaxial cable is provided as the transmission line cable 124. However, other transmission line cables could also be used. The center conductor 128 of the cable is connected to the first connection point 170, and the outer conductor 126 of the cable is connected to the second connection point 166. Any suitable means may be used to form these connections, including soldering, spot welding, crimping, and application of conductive paste or glue. A connection point cover 174 is provided to protect the cable and connection points, and may be formed from any suitable insulating material. Relief openings 172, 164 are preferably formed in the CIP outer laminating film layer 156 to allow the electrical connection to be made without damaging the layer 156.

The stepped slot 160 divides CIP planar conductor 154 into a first substantially linear conductive strip (including segments 180 and 184), second substantially linear conductive strip (including segments 178 and 182), which are electrically shorted in the region of 188. At the operating frequencies of the antenna 100 the conductive strips function as transmission line sections. The dimensions of the strips and the slots, and the dimensions and dielectric constant of adjacent materials, including, especially that of the glass panel 114 or another dielectric to which the coupler is applied and the surrounding air, control the electrical characteristics of the transmission line sections. The conductive strips, in cooperation with complementary conductive strips of the CEP 116, form a transmission line structure which provides coupling between the connection port of the CIP 120 and the connection port of the CEP 116. The transmission line structure also provides suitable impedance matching so that the coupler 110 presents desired impedance characteristics at those ports. An analysis of the electrical behavior of the coupler is discussed below in greater detail.

In a preferred embodiment of the present invention, designed for dual-bard operation at cellular and PCS frequencies, the CIP planar conductor 154 may be formed as a generally rectangular sheet having an overall length a, and an overall width b. The CIP transmission line slot 160 extends longitudinally from a short end of the sheet and is approximately centered between the long ends of the sheet. The transmission line slot has a wide slot region 158 of width f extending inward a distance e from the short end.

The transmission line slot 160 forms first and second transmission line segments 178 and 180, of approximate width h, in the CIP planar conductor 154. The CIP transmission line slot 160 also has a narrow slot region 162 of width g extending further inward a distance d from the inner end of the CIP wide slot region 158. The narrow slot region 162 is not centered. The CIP narrow slot region 162 forms third and fourth transmission line segments 182 and 184 in the CIP planar conductor 154. The connection points 172 and 166 are intermediately located on transmission line segments 184 and 182 on opposite sides of the CIP narrow slot region 162. The CIP narrow slot region 162 ends a distance c from the opposite short end of the CIP planar conductor 154. Thus, in the region designated 188, the third and fourth transmission line segments 182 and 184 are shorted. In the preferred embodiment, the dimensions are as follows: a=3½ in; b=1.0 in; c=½ in; d=1$^{5}/_{16}$ in; e=1⅜ in; f=⅜ in; g=$^{1}/_{32}$ in; and h=$^{5}/_{16}$ in.

Figure 4:
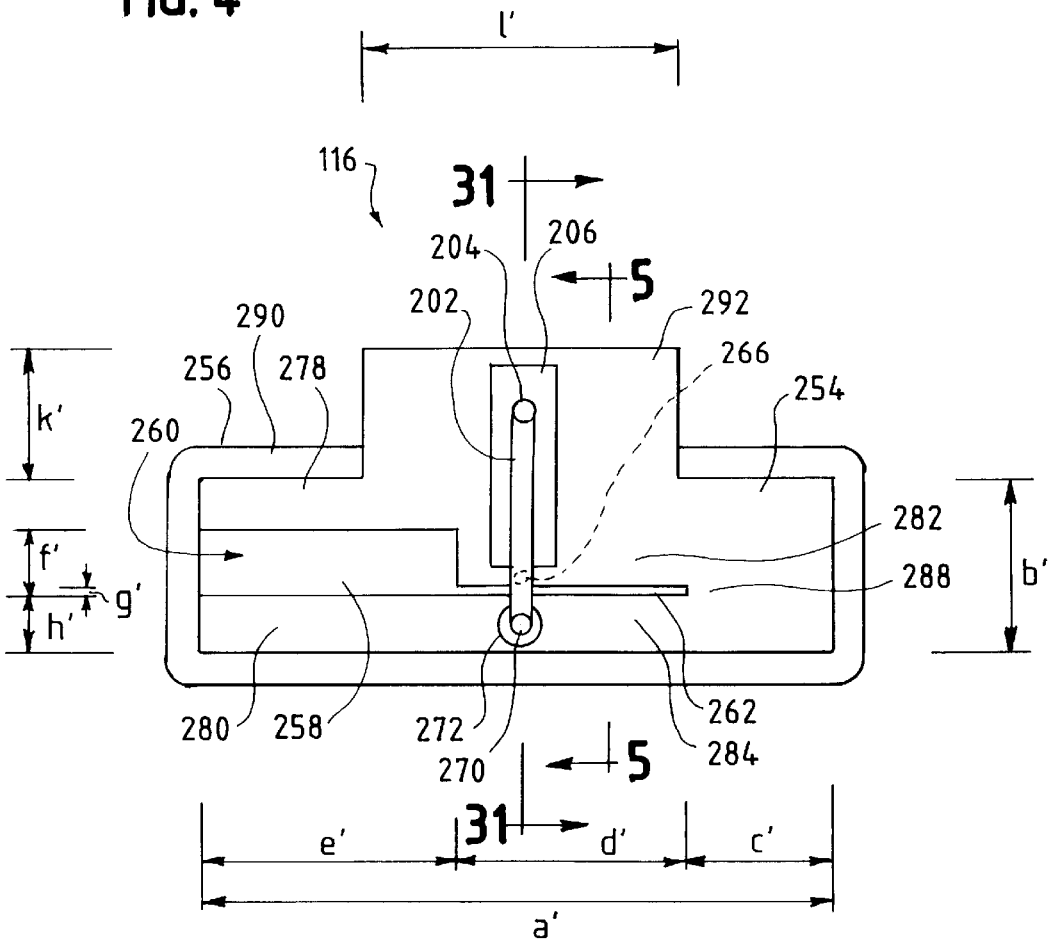
FIG. 4 is a downward-looking plan view of the exterior portion of the through-the-glass coupler for use in the antenna system 100 of FIG. 1.
Figure 5:
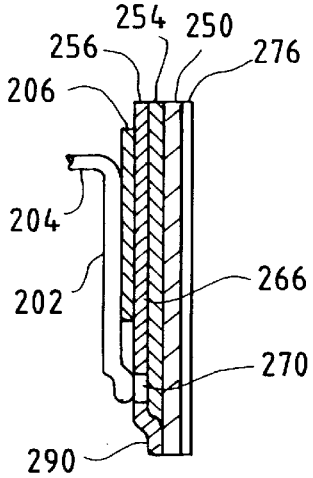
FIG. 5 is a side cross-section view of the exterior portion of the through-the-glass coupler of FIG. 4, taken along the view lines 5—5 thereof.

As best seen in FIGS. 1, 4, and 5, the CEP 116 is adapted to be mounted on the exterior surface 118 of glass panel 114, for supporting a dual-band antenna/radiator element 112 and for providing coupling thereto. Accordingly, although CEP 116 is similar in structure to CIP 120, CEP 116 incorporates additional structures for mechanically supporting an attached radiator 112, and for providing impedance matching and electrical connection to the radiator 112. In addition, CEP 116 may act as a counterpoise for the radiator at some frequencies. If the coupler 110 is used in an application in which the radiator 112 is not present, for example, an application in which transmission line cables are connected to the connection ports of both CIP 120 and CEP 116, the additional structures may be omitted, and the CEP 116 could be constructed essentially as a mirror image of CIP 120. The additional structures could, therefore, be considered to be part of the antenna/radiator element 112.

The CEP 116 is generally formed as a substantially planar, flexible conductive sheet 254 laminated between an inner insulating sheet layer or film 250 and an outer insulating sheet layer or film 256. The term "exterior" is used here to denote that in a typical vehicular application, CEP 116 is installed on the outward-facing surface 118 of glass panel 114. When installed, the inner laminating film layer 250 faces exterior surface 118 of glass panel 114.

Like the CIP planar conductor 154, the CEP planar conductor 254 may be formed from any suitable flexible, conductive sheet material which is compatible with the inner and outer laminating film layers 250, 256. For example, the CIP planar conductor 254 may be formed from a conductive sheet, foil, or film, such as aluminum, copper, silver, and various conductive alloys, or from a composite material having a conductive component, such as thin printed circuit board material. The considerations which apply to the selection of CEP planar conductor 254 are essentially the same as those noted for CIP planar conductor 154. In a preferred embodiment of the invention, the CIP planar conductor 254 is formed from brass sheet. The thickness of the CIP planar conductor 254 may range from 0.001 in to 0.050 in. In a preferred embodiment of the invention, the CIP planar conductor 254 is 0.010 inches thick.

Any suitable insulating film material may be used to form CEP inner and outer laminating film layers 250 and 256. Layers 250 and 256 provide mechanical support and for the CEP planar conductor 254, which may be fragile. In addition, layers 250 and 256 protect the CEP planar conductor 254 from environmental factors, such as contaminants, which may promote corrosion or deterioration. The considerations which apply to the selection of CEP inner and outer laminating film layers 250 and 256 are essentially the same as those noted for CIP inner and outer laminating film layers 150 and 156. Because the CEP 116 is intended for use on the exterior of the vehicle, materials are preferably selected to avoid damage from environmental factors. However, layers 250 and 256 do not contribute significantly to the electrical performance of the CEP 116, and therefore, one or more of the layers 250 and 256 may be omitted in some applications. In a preferred embodiment of the invention, the inner and outer laminating film layers 250 and 256 are formed from polyester film material. The thickness of the inner and outer laminating film layers 250 and 256 may range from 0.005 in to 0.020 in. In a preferred embodiment of the invention, the inner and outer laminating film layers 250 and 256 are 0.005 in thick.

Assembly of the CEP inner and outer laminating film layers 250 and 256 and CEP planar conductor 254 into a laminated sheet may be performed by methods well known in the art. As best seen in FIG. 4, the inner and outer laminating film layers 250 and 256 may extend, in certain regions, beyond the boundaries of the CEP planar conductor 254 to form an apron 290 of laminating film to provide additional structural support and avoid contamination at the edges of the CEP planar conductor 254.

An adhesive layer 276 is preferably provided on the outside surface of the inner laminating film layer 250 to secure the CEP 116 to the glass panel 114. Any suitable adhesive which is compatible with the glass panel 114 (or any other dielectric structure to which the coupler is applied), and the CEP inner laminating film layer 250, may be used. Preferably, the adhesive is a thin pressure sensitive adhesive which may be applied to the inner laminating film layer 250 during manufacture of the coupler, thereby facilitating application of the CEP 116 to the glass panel 114. For example, a suitable adhesive is available from the 3M Company under the designation SCOTCH VHB 15-mil Foam Tape. However, other adhesives, such as various glues or cement, could also be used. Alternatively, the inner laminating film layer 250 could be thermally bonded to the exterior surface 118 of glass panel 114.

The CEP planar conductor 254, which may act as a counterpoise, is preferably shaped as a generally rectangular sheet having a longitudinally-extending stepped-width slot 260 formed therein. A counterpoise extension 292 may be provided to improve impedance matching and radiation characteristics when the coupler 110 is used with radiator 112. The counterpoise extension 292 may be formed as a rectangular projection extending from one of the long edges of the CEP planar conductor 254. With the exception of the counterpoise extension 292, the CEP planar conductor 254 is preferably formed as a mirror-image of the CIP planar conductor 154. A first electrical connection point 270 is provided on a first side of the slot 260, and a second electrical connection point 266 is provided on the opposite side of the slot 260. The electrical connection points 270 and 266 form a second connection port for the coupler 110.

If the coupler 110 is used with radiator 112, electrical connection therefor may be made at one of the connection points 270 and 266. In that case, the connection is preferably made at connection 270 to enable the radiator 112 to cooperate with counterpoise extension 292, which is effectively connected to connection point 266. If the coupler 110 is used with an antenna/radiator element for which a counterpoise is not desirable, the connection to that element may be made at either connection point 270 or 266. If the CEP 116 is to be connected to a transmission line cable, the cable may be electrically connected to the CEP planar conductor 254 at the connection points 270 and 266. Any suitable means may be used to form these connections, including soldering, spot welding, crimping, and application of conductive paste or glue. Relief openings 272, 264 are preferably formed in the CEP outer laminating film layer 256 to allow the electrical connection to be made without damaging the layer 256.

Preferably, a coupler exterior circuit housing and radiator mount 130 (FIGS. 1, and 6–7) is provided to protect the connection points and to mechanically support the radiator 112. The coupler exterior circuit housing and radiator mount 130 may be formed from any suitable insulating material and prevents forces exerted on the radiator from damaging the CEP 116, the CEP planar conductor 254, or the connection points 270, 266. The coupler exterior circuit housing and radiator mount 130 is discussed further in greater detail.

The stepped slot 260 divides CEP planar conductor 254 into a first substantially linear conductive strip (including segments 280 and 284), and a second substantially linear conductive strip (including segments 278 and 282, which are electrically shorted in the region of 288. At the operating frequencies of the antenna 100 the conductive strips function as transmission line sections. The conductive strips, in cooperation with complementary conductive strips of the CIP 120, form a transmission line structure which provides coupling between the connection port of the CIP 120 and the connection port of the CEP 116. The transmission line structure also provides suitable impedance matching so that the coupler 110 presents desired impedance characteristics at those ports. An analysis of the electrical behavior of the coupler is discussed further in greater detail.

In a preferred embodiment of the present invention, designed for dual-band operation at cellular and PCS frequencies, the CEP planar conductor 254 is formed as a generally rectangular sheet. With the exception of the counterpoise extension 292, the CEP planar conductor 254 is preferably formed as a mirror-image of the CIP planar conductor 154, in which components of the CEP planar conductor 254 have the same dimensions as complementary components of CIP planar conductor 154. Thus, the CEP planar conductor 254 has an overall length a', and an overall width b'. The CEP transmission line slot 260 extends longitudinally from a short end of the sheet and is approximately centered between the long ends of the sheet. The transmission line slot has a wide slot region 258 of width f' extending inward a distance e' from the short end.

The transmission line slot 260 forms first and second transmission line segments 278 and 280, of approximate width h', in the CEP planar conductor 254. The CEP transmission line slot 260 also has a narrow slot region 262 of width g' extending further inward a distance d' from the inner end of the CEP wide slot region 258. The narrow slot region 262 is not centered. The CEP narrow slot region 262 forms third and fourth transmission line segments 282 and 284 in the CEP planar conductor 254. The connection points 272 and 266 are intermediately located on transmission line segments 284 and 282 on opposite sides of the CEP narrow slot region 262. The CEP narrow slot region 262 ends a distance c' from the opposite short end of the CEP planar conductor 254. Thus, in the region designated 288, the third and fourth transmission line segments 282 and 284 are shorted.

The counterpoise extension 292 may be formed as a rectangular member projecting a distance k from one of the long edges and extending along a longitudinal distance l. The counterpoise extension 292 is preferably approximately centered about a transverse line extending through the connection points 270 and 266. As is known in the art, other shapes and structures could also be used to form a counterpoise extension. In the preferred embodiment, the dimensions are as follows: a'=3½ in; b'=1.0 in; c'=½ in; d'=1$\frac{5}{16}$ in; e'=1⅜ in; f'=⅜ in; g'=$\frac{1}{32}$ in; and h'=$\frac{5}{16}$ in; k=¾ in; and l=1¾ in.

The CIP 120 and CEP 116 are preferably installed in directly opposing locations on the interior and exterior surfaces 122, 118 of glass panel 114. Considering the CIP 120 in isolation, when excited by a source of RF energy, the CIP conductive strip segments 178–182 and 180–184 function as transmission line sections operating in the "co-planar strip line mode." Similarly, considering the CEP 116 in isolation, when excited by a source of RF energy, the CEP conductive strip segments 278–282 and 280–284 function as transmission line sections operating in the "co-planar strip line mode." In addition, the conductive strips 178–182 and 180–184 of the CIP, and 278–282 and 280–284 of the CEP, function cooperatively to form a four-conductor transmission line operating in the "coupled microstrip line odd mode," thereby achieving coupling through the material of glass or other dielectric panel 114. As discussed further in greater detail, the transmission line characteristics are selected to achieve desired impedances in the cellular and PCS frequency bands. The CIP 120 and CEP 116 thus function in cooperation to provide a through-the-glass coupler 110 which exhibits impedance characteristics within a desired range, and which exhibits minimized insertion loss, at both cellular and PCS frequencies.

As best seen in FIGS. 1 and 4–7, a suitable dual-band antenna/radiator element 112 is preferably electrically connected to CEP first connection point 270 and mechanically supported by coupler exterior circuit housing and radiator mount 130. The mount 130 may be formed from any suitable insulating material, such as an insulating plastic. The mount may be formed in a generally rectangular shape having a raised center section 212, and two lower "wing" portions 208 and 210 adjacent to the center section 212. The raised portion 212 preferably covers; a cavity or tunnel 216. An antenna support block 214 is provided to support the radiator element 112 at a position offset in the direction of counterpoise extension 292 from the CEP first connection point 270.

A conductor 202 extends through the tunnel between CEP first connection point 270 and to an antenna attachment stub 204. The antenna attachment stub 204 is electrically and mechanically connected to a radiator mounting projection 134 extending upward from the antenna support block 214. An layer of insulating material 206 is provided to maintain a desired separation between the conductor 202 and the underlying CEP planar conductor 254 and counterpoise extension 292. The conductor 202, the insulating layer 206, the CEP planar conductor 254 and the counterpoise extension 292 cooperate to form a transmission line. The transmission line length and characteristic impedance are selected such that the transmission line acts as an impedance matching transformer at PCS frequencies, and complements the low impedance presented by the base of the radiator at cellular frequencies. Operation of the impedance matching transmission line is discussed below in greater detail.

Figure 7:
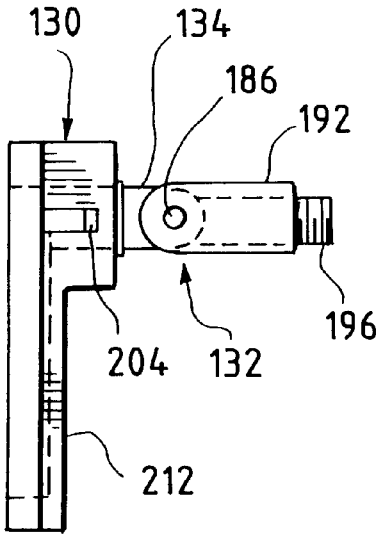
FIG. 7 is a side cross section view of the housing and mount of FIG. 6, taken along the view lines 7—7 thereof.
Figure 6:
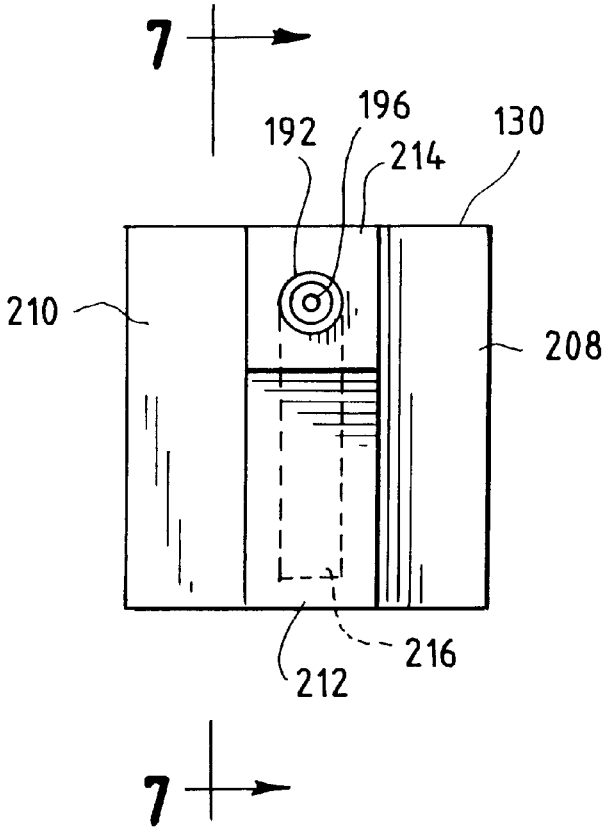
FIG. 6 is a top plan view of a housing and mount for protecting the circuit components of the exterior portion of the coupler and for supporting the radiator element.

As best seen in FIGS. 1, and 6–7, the coupler exterior circuit housing and radiator mount 130 provides a radiator mounting projection 134. The projection 134 cooperates with a mating mounting projection adapter 192 to form a radiator swivel mount assembly 132. The mounting projection adapter 192 has a notch for receiving radiator mounting projection 134 and a pivot dowel 186 for retaining the mounting projection 134. The mounting projection adaptor 192 supports the remaining components of the antenna/radiator element 112. The radiator swivel mount assembly 132 permits installation of the radiator 112 at an adjustable desired angle, despite variation in the angle of glass panel 114 among various vehicles or other installation sites.

The radiator 112 comprises the following electrically relevant components, which are electrically and mechanically connected to one another in this order: a whip adaptor and lower radiator section 136 of length m, comprising mounting projection adapter 192, and a whip base 194; a phasing coil 138 of length n; a middle whip radiator 140 of length p; a PCS band choke assembly 142 of length and an upper whip radiator 148 of length r. In the preferred embodiment, the dimensions are as follows: m=3 in; n=3 in; p=2¾ in; q=1 in; and r=3¼ in.

The PCS band choke assembly 142 comprises a cylindrical PCS choke sleeve 144 spaced radially from an inner conductor extension of the lower whip radiator 140. A dielectric filler 146 is provided between the PCS choke sleeve 144 and the inner conductor. The upper end of the PCS choke sleeve 144 is shorted to the center conductor. The PCS band choke assembly 142 forms a shorted transmission line having an effective electrical length of one quarter wavelength at PCS frequencies. The PCS band choke assembly 142 effectively eliminates any current flow beyond the base of the PCS choke sleeve 144 at PCS frequencies. Thus, at PCS frequencies, the radiating section above the phasing coil 138 is approximately one half wavelength. At cellular frequencies, the PCS band choke assembly 142 has little effect, and therefore, the entire assembly above the phasing coil 138 forms a half-wavelength radiator. Other configurations for the PCS choke assembly could also be used. For example, the PCS choke assembly could be implemented using a choke coil which would minimize currents on the upper radiator at PCS frequencies.

The lower radiating section of the radiator 112 has an electrical length on the order of one half wavelength at PCS frequencies. Therefore, the base of radiator 112 presents a relatively high impedance, on the order of 500Ω, at PCS frequencies. Thus, the antenna matching section (including conductor 202) operates at PCS frequencies to improve the antenna's VSWR, which would otherwise be undesirably high. In the cellular band, the radiator 112 has an electrical length of approximately one quarter wavelength, and therefore the base of the radiator 112 presents a characteristic impedance on the order of 30–40Ω. At cellular frequencies, the antenna matching section provides a relatively small transformation of the impedance presented by the base of the radiator, resulting in an improved impedance response approaching 50Ω.

Figure 33:
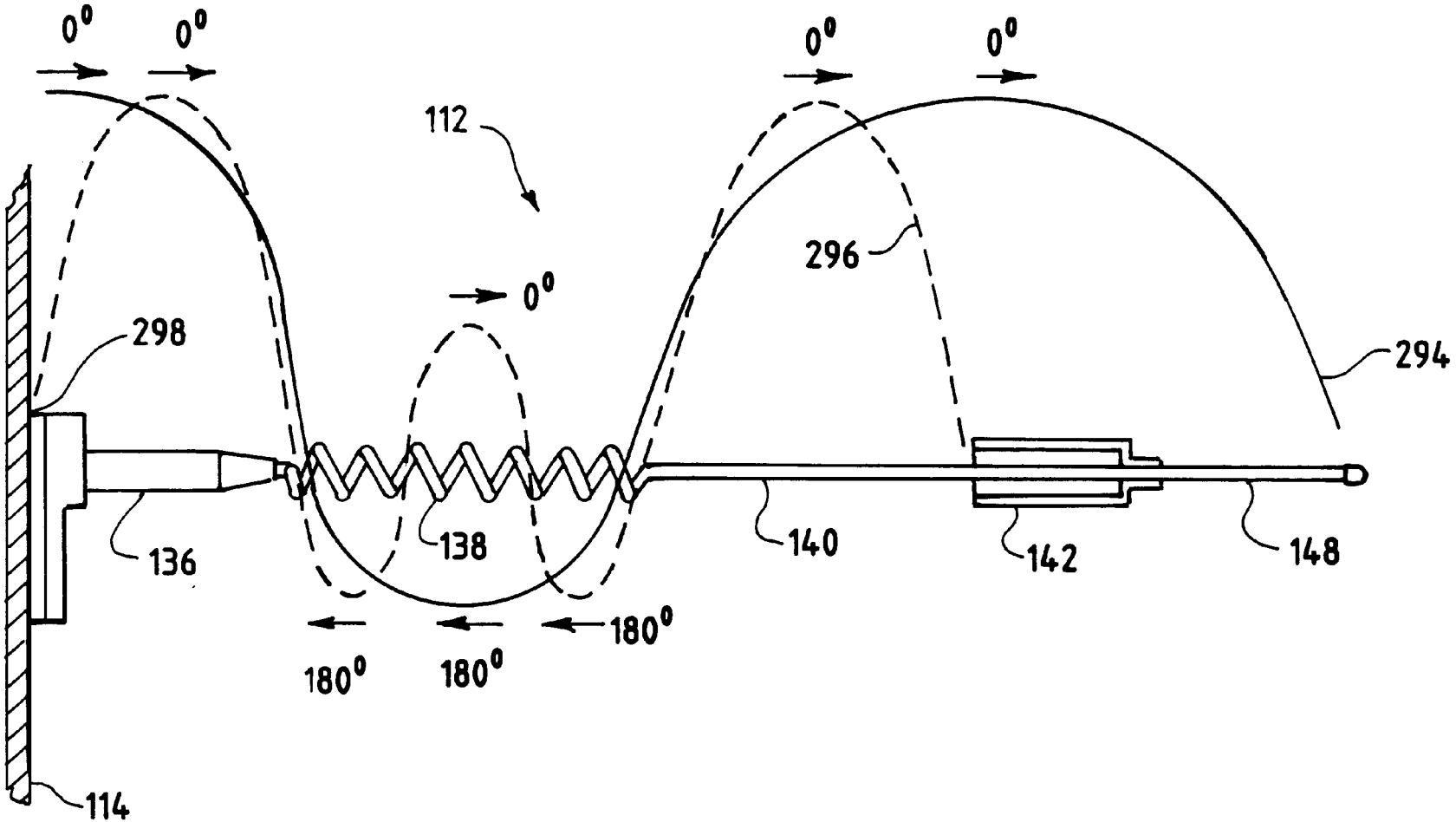
FIG. 33 is a diagram showing the relative amplitudes and phase of the current distribution along the dual-band antenna/radiator element of FIG. 1, at cellular and PCS frequencies, as determined from current probe measurements.

The phasing coil 138 achieves an "in-phase" condition between the upper and lower co-linear radiators at both cellular and PCS frequency ranges. FIG. 33 is a diagram of the relative amplitudes and phase of the current distribution along the dual-band antenna/radiator element 112 at cellular and PCS frequencies as determined from current probe measurements, using a network analyzer. The current distribution at cellular frequencies is represented by solid line 294. the current distribution at PCS frequencies is represented by broken line 296.

At cellular frequencies, maximum current occurs at the base 298 of the lower radiator, and at the center of the assembly comprising middle radiator 140, PCS choke assembly 142, and upper radiator 148. The two maximum current regions are "in-phase," as shown by the direction of the upward-pointing arrows. In the region of the phasing coil 138, the current is "out-of-phase" with respect to the maximum current regions, as shown by the downward-pointing arrow. Although measurable with a current probe, the current in the region of the phasing coil 138 is effectively non-radiating, and therefore this current does not affect the radiation characteristics of the antenna. Antenna pattern measurements have shown that at cellular frequencies, this radiator configuration exhibits an omnidirectional radiation pattern, with an E-plane beam width in the order of 37°, which is consistent with that expected of a two element collinear array.

At PCS frequencies, maximum current occurs at the center of the lower radiator, and at the center of the middle radiator 140 between the top of the phasing coil 138 and the open end of the PCS choke sleeve 144. The two maximum current regions are "in-phase," as depicted by the direction of the upward-pointing arrows. In the region of the phasing coil 138, the current probe measurements show that secondary current peaks occur. Two of the peaks are "out-of-phase" with the primary maximum current regions, while one of the peaks is "in phase." The symmetry of the secondary current in the region of the phasing coil 138 is believed to be a requirement in order to achieve "in-phase" radiation characteristics for the two-element collinear array formed by dual-band antenna/radiator element 112. Since the secondary current in the region of the phasing coil 138 is effectively non-radiating, the radiation characteristics of the antenna are not affected. Antenna pattern measurements have shown that at PCS frequencies, this radiator configuration exhibits an omnidirectional radiation pattern, with an E-plane beam width in the order of 31 degrees, which is consistent with that expected of a two-element collinear array.

Although not entirely understood, the pitch, number of turns, wire diameter, and coil diameter of the phasing coil 138 seem to be important parameters in achieving proper phasing in both cellular and PCS frequency ranges.

The antenna/radiator element 112 described above is one which advantageously provides approximately 2–3 dB of gain over a dipole, or 4–5 dB gain over an isotropic radiator element. However, other types of radiators could also be used. In particular, a simple linear whip radiator of appropriate length may also be used with the coupler 110 to present an impedance equivalent to the radiator 112 described below. For example, a suitable radiator could be constructed in a manner similar to that described for radiator 112, but omitting the phasing coil and all of the components above it. The resulting radiator is, in essence, a whip radiator having a length of 3.0 in, which is capable of operation in both the cellular and PCS bands. The whip radiator is on the order of a quarter wavelength at cellular frequencies, and on the order of a half wavelength at PCS frequencies. Such a short radiator will exhibit 0 dB gain referenced to a dipole radiator.

Figure 8A:
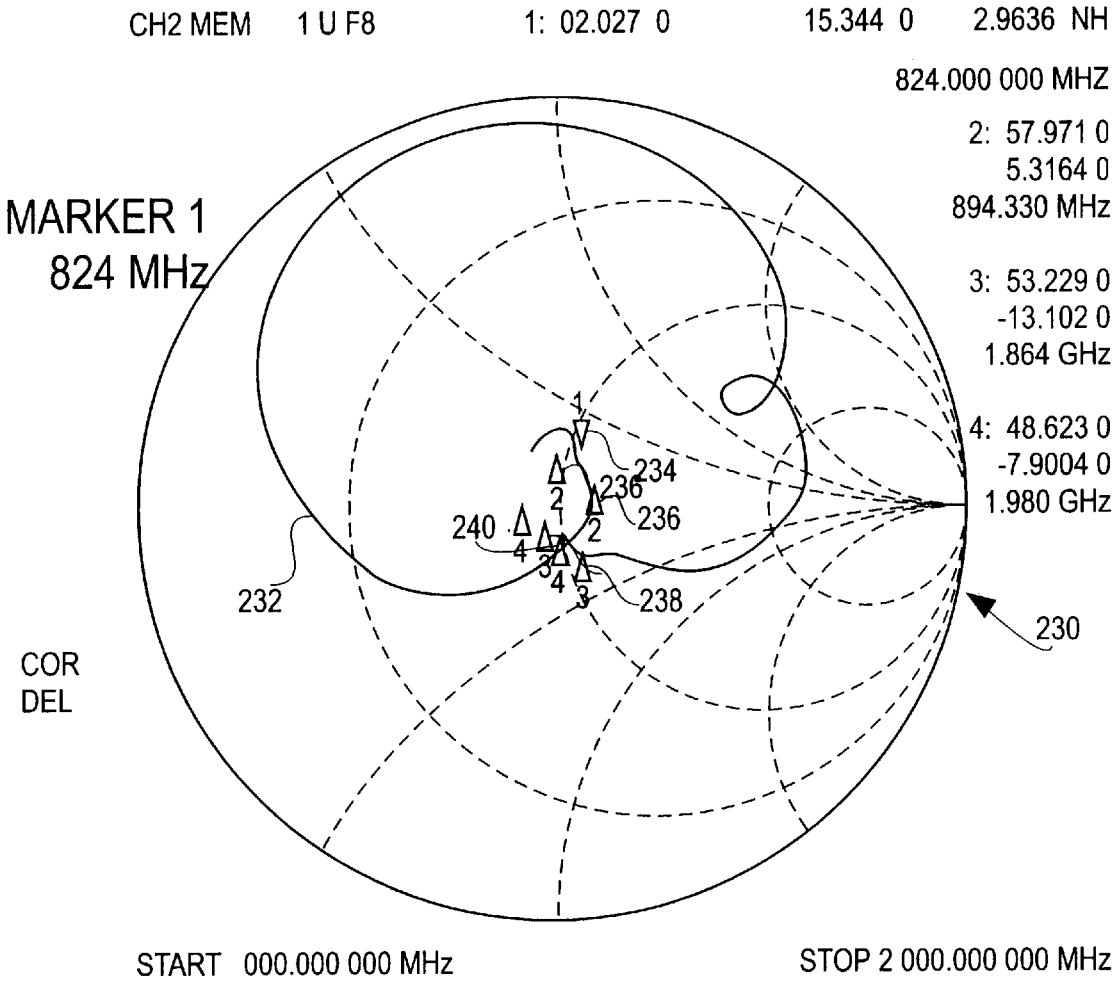
FIG. 8*a* is a Smith chart showing a plot of the input impedance of the through-the-glass coupler of FIGS. 1–6, produced from measurements obtained at the input port of a prototype embodiment of the coupler, with the output port of the coupler connected to a 50 ohm load.

FIG. 8*a* is a Smith chart showing a plot of the input impedance of the dual-band, through-the-glass coupler 110. The chart was produced from measurements obtained at the first connection port of a prototype embodiment of the coupler. The second connection port of the coupler was connected to a 50Ω load so that the performance of the coupler could be measured independent of the performance of radiator 112. The chart shows that the coupler impedance varies from approximately 37 to 42Ω throughout the cellular band, and from approximately 44 to 54Ω throughout the PCS band. In addition, the VSWR remains below 1.5:1 at all frequencies within the cellular and PCS bands.

Figure 8B:
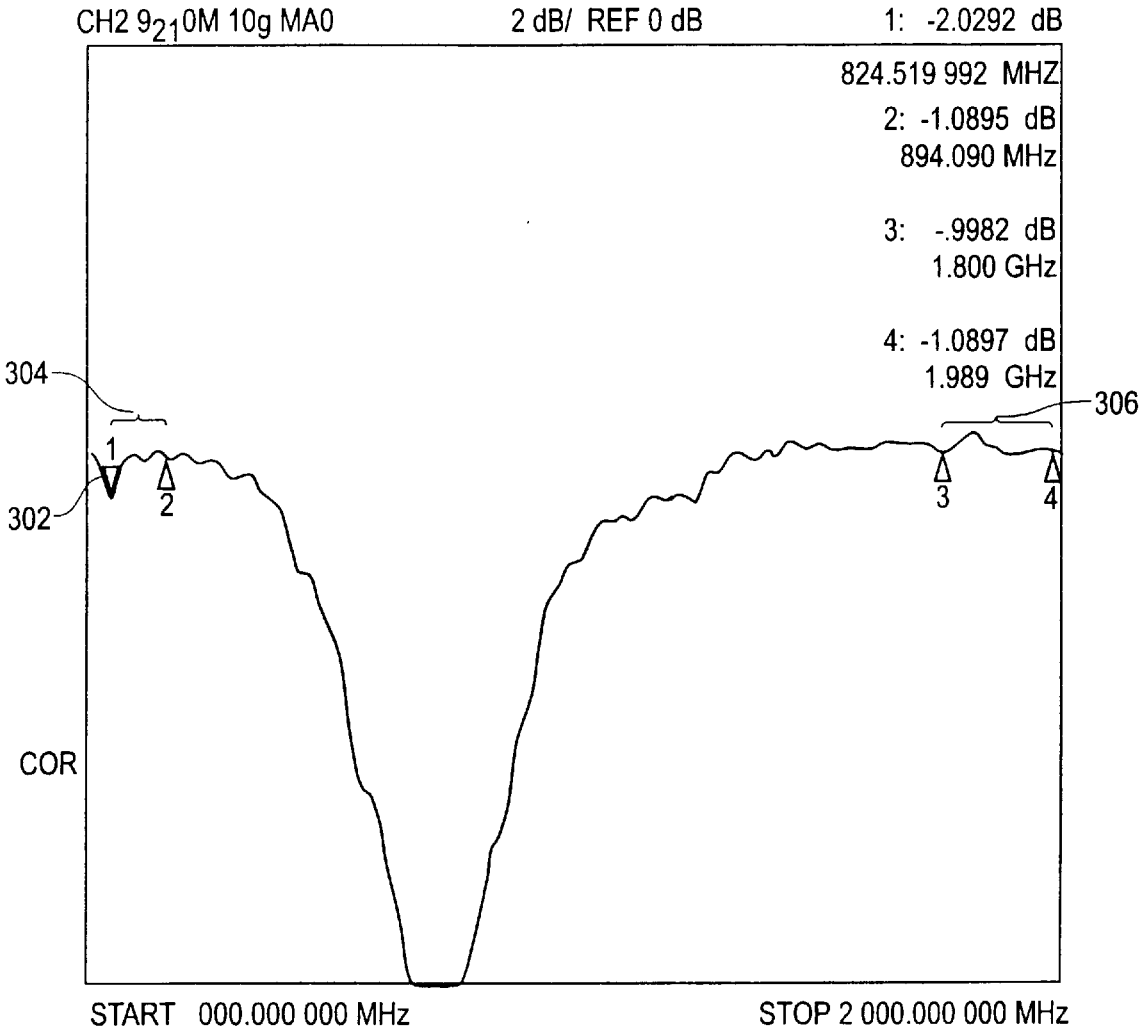
FIG. 8*b* is a chart showing a plot of the insertion loss of the through-the-glass coupler of FIGS. 1–6, produced from measurements obtained using a prototype embodiment of the coupler.

FIG. 8*b* is a chart showing a plot 302 of the insertion loss of the through-the-glass coupler 110 of FIGS. 1–6, at cellular and PCS frequencies, produced from measurements obtained using a prototype embodiment of the coupler. The measured insertion loss of the coupler 110 at cellular frequencies is shown in the region designated 304. The measured insertion loss of the coupler 110 at PCS frequencies is shown in the region designated 306. In both frequency bands, the measured insertion loss is on the order of 1.0 dB, indicating that the coupler 110 provides excellent performance.

Figure 9:
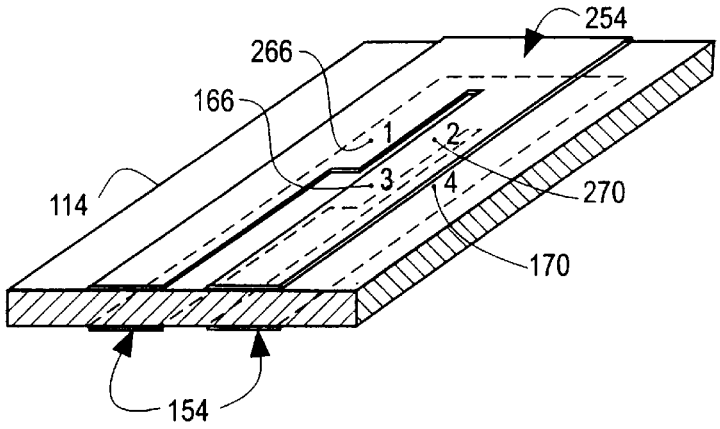
FIG. 9 is a simplified, upward-looking perspective view of the through-the-glass coupler of FIGS. 1–5, provided to assist in understanding the equivalent circuit of the coupler.

FIG. 9 is a simplified, upward-looking perspective view of the through-the-glass coupler 110 of FIGS. 1–5, which will assist in understanding the equivalent circuit of the coupler. At cellular and PCS frequencies, the conducting strips of the CIP and CEP planar conductors 154, 254 behave as transmission lines. It is believed that the fundamental principle on which the coupler works is the excitation of the coupled microstrip line odd mode and the coupled co-planar strip line mode from a signal source on one side (e.g., CEP planar conductor 254) of the dielectric 116, thereby causing these same two modes to exist on the opposite side (e.g., CIP planar conductor 154), from which the load impedance (e.g. radiator 112) can be driven. The coupled microstrip line odd mode provides the "through the glass" coupling needed in an antenna application.

Figure 10A:
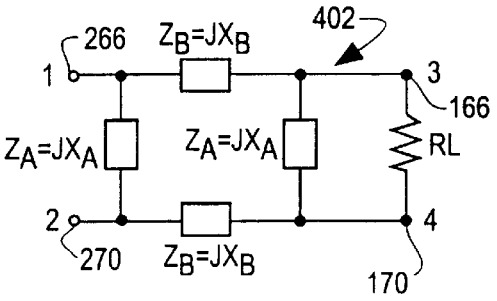
FIG. 10*a* is an electrical schematic diagram of a circuit which is electrically equivalent to the through-the-glass coupler of FIGS. 1–5 and 9, for use in connection with an explanation of the operation of the coupler.
Figure 10B:
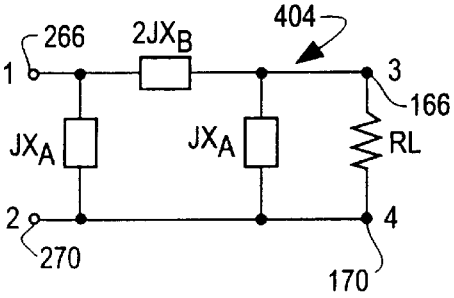
FIG. 10*b* is a electrical schematic diagram of a circuit equivalent to the circuit of FIG. 10*a*, but showing the two series impedances of FIG. 10*a* combined to form a traditional pi-network.

FIG. 10*a* is an electrical schematic diagram of a circuit 402 which is electrically equivalent to the through-the-glass coupler 110 of FIGS. 1–5 and 9. The circuit 402 represents a reciprocal two-port network, in which a first port corresponds to CIP first connection point 170 and CIP second connection point 166, and a second port corresponds to CEP first connection point 270 and CEP second connection point 266. Any reciprocal two-port network can be represented by a pi-network. FIG. 10*b* is a electrical schematic diagram of a circuit 404 which is equivalent to the circuit of FIG. 10*a*, but in which the two series impedances $Z_B$ of FIG. 10*a* are combined to form a traditional pi-network. The properties of the pi-matching network are well known. A load resistance $R_L$ can be matched to a generator with an internal resistance $R_g=R_L$ by a range of values for $X_A$ and $X_B$. The requirement is that $X_A$ and $X_B$ be of the opposite sign and that $$\frac{X_B}{R_L} = \overline{X}_B = -\frac{\frac{X_A}{R_L}}{1+\left(\frac{X_A}{R_L}\right)^2} = -\frac{\overline{X}_A}{1+\overline{X}_A^2}.$$

The parameter tolerances are less if $X_A$ is of the order of $R_L$ or larger and $X_B$ is then smaller.

Figure 11:
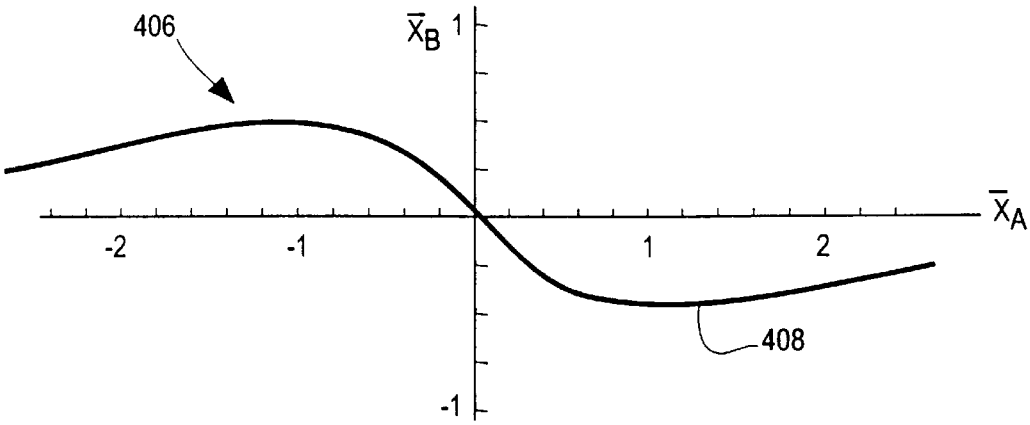
FIG. 11 is a graph showing the relationship between a parameter $\overline{X}_B$, derived from series reactance, and a parameter $\overline{X}_A$, derived from the shunt reactances, of the pi-network of FIG. 10, which enable the pi-network to match a selected load impedance.

FIG. 11 is a graph 406 showing the relationship 408 between a parameter $\overline{X}_B$, derived from series reactance, and a parameter $\overline{X}_A$, derived from the shunt reactances, of the pi-network 404 which enable the pi-network to match a selected load impedance. The maximum value for $\overline{X}_B$ is $-\overline{X}_A$.

The availability of a range of values for $X_A$ and $X_B$ simplifies the design of coupler 110. The coupler may be constructed by selecting transmission line characteristics such that the transmission line network provides a suitable pair of values for $X_A$ and $X_B$ at each desired operating frequency. Values for $X_A$ in the range of $R_L$ and larger are suitable. The pi-network can also match complex load impedances, as is well known. In practice, small values of $X_A$ and $X_B$ work poorly because circuit losses make the impedance match poor. In the following discussion, $$Y_A = \frac{1}{jX_A}, \quad \text{and} \quad Y_B = \frac{1}{jX_B}.$$

By using even and odd excitation at the input and output ports in the equivalent circuit shown in FIG. 10, and correspondingly, at the two ports of the transmission line coupler, the input currents can be compared to establish the values of the reactances $X_A$ and $X_B$ in the equivalent circuit, in terms of reactances evaluated for the transmission line circuits. Even excitation is obtained by connecting voltage generators of the same polarity at each port, while odd excitation is obtained by connecting voltage generators of opposite polarity at the two ports.

Figure 12:
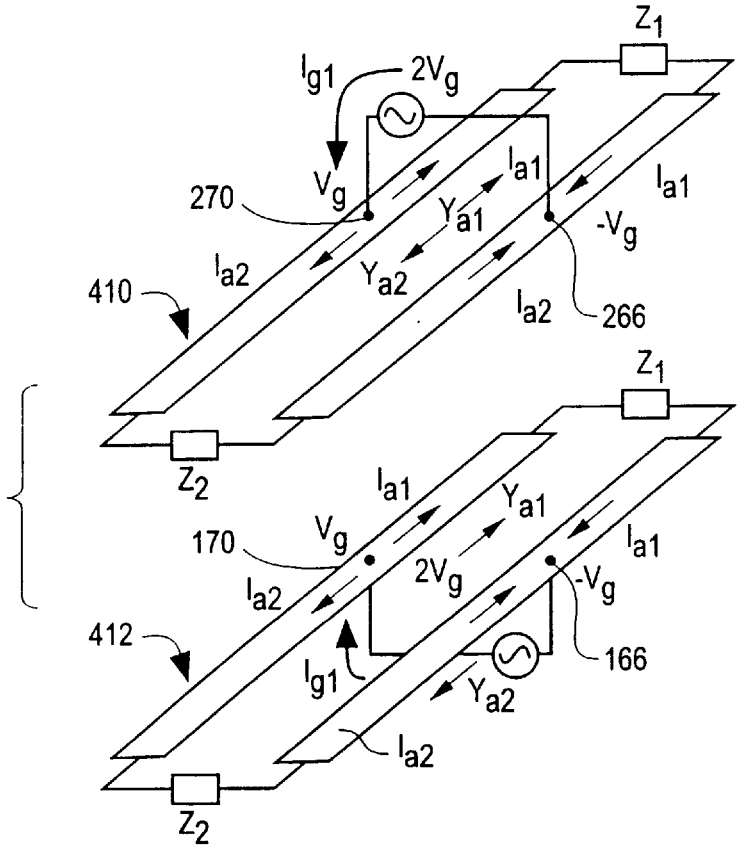
FIG. 12 is a simplified electrical schematic diagram showing an analysis of the operation of the through-the-glass coupler when the input and output ports of the coupler are connected to generators of the same polarity, exciting each of the upper and lower portions of the circuit to operate in the co-planar strip-line mode.
Figure 13:
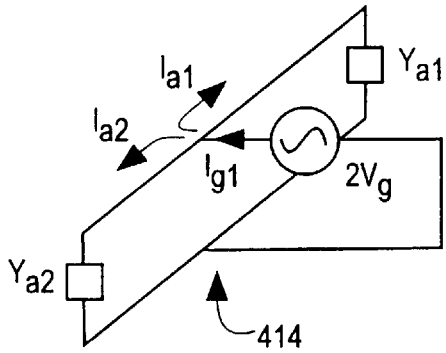
FIG. 13 is a simplified electrical schematic diagram showing the current flow in the circuit of FIG. 12, taking into account that in the co-planar strip-line mode the same currents flow on both upper and lower transmission lines.

FIG. 12 is a simplified electrical schematic diagram showing an analysis of the operation of the through-the-glass coupler 110 when the input port (connection points 270, 266) and output port (connection points 170, 166) of the coupler are connected to generators of the same polarity. This configuration excites each of the upper and lower portions 410, 412 of the circuit (equivalent to CEP planar conductor 254 and CIP planar conductor 154) to operate in the co-planar strip-line mode. These two co-planar strip line modes interact to form a coupled co-planar strip line mode (mode a). Let both upper and lower lines be driven by voltage generators with voltage $2V_g$. The currents $I^{a1}$ and $I_{a2}$ that flow are given by $I_{a1}=2V_gY_{a1}$ and $I_{a2}=2V_gY_{a2}$ where $Y_{a1}$ and $Y_{a2}$ are the two input admittances looking toward $Z_1$ and $Z_2$ respectively on the transmission line. This drive excites the coupled co-planar strip line mode on both the upper and lower transmission lines 410 and 412. FIG. 13 is a simplified electrical schematic diagram 414 showing the current flow in the circuit of FIG. 12. The same currents flow on both upper and lower transmission lines 410 and 412. The generator supplies current $I_{g1}=I_{a1}+I_{a2}=2V_g(Y_{a1}+Y_{a2})=2V_gY_a$. The same excitation applied to the equivalent circuit in FIG. 10 would result in the same currents. There will be zero current in the impedance $Z_B$ and a current $2V_gY_A$ in $Z_A$, and thus the impedance $Z_A$ in FIG. 10 can be equivalently identified as $1/Y_a$.

Figure 14:
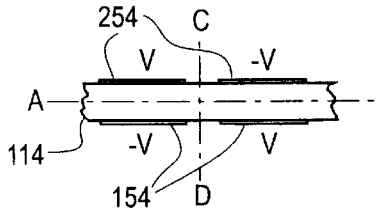
FIG. 14 is a digram showing the distribution of relative voltages on a four-conductor transmission line operating in the coupled microstrip line odd mode.

FIG. 14 is a diagram showing the distribution of relative voltages on a four-conductor transmission line, formed by CEP and CIP planar conductors 254, 154 operating in the coupled microstrip line odd mode. For the coupled microstrip odd mode, planes AB and CD are zero potential or "virtual" short circuits.

Figure 15:
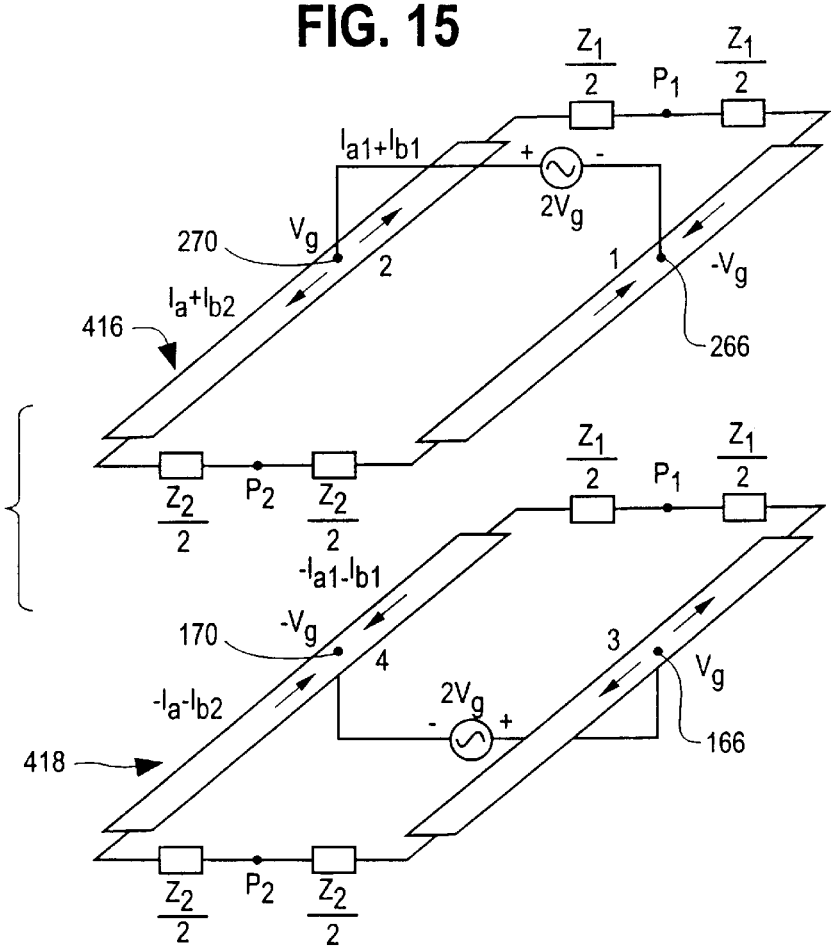
FIG. 15 is a simplified electrical schematic diagram showing an analysis of the operation of the through-the-glass coupler when the input and output ports of the coupler are connected to generators of opposite polarity, exciting the coupled microstrip line odd mode in the four conductors.

FIG. 15 is a simplified electrical schematic diagram showing an analysis of the operation of the through-the-glass coupler 110 when the input port (connection points 270, 266) and output port (connection points 170, 166) of the coupler of the coupler are connected to generators of opposite polarity. With the two generators connected with opposite polarities, the coupled microstrip line odd mode (mode b) is excited. $Z_1$ and $Z_2$ are split in two to show the zero-potential points, $P_1$ and $P_2$. When $Z_1$ is a short circuit and mode b is excited, a virtual short circuit is seen at $P_1$. When $Z_2$ is an open circuit and mode b is excited, an open circuit is also seen at $P_2$. Points 1–2 and 3–4 (connection points 266–270, and 166–170, respectively) have a potential difference $2V_g$. Likewise points 1–3 and 2–4 have a potential difference of $2V_g$, and hence the coupled microstrip line odd mode must exist on the structure.

Figure 16:
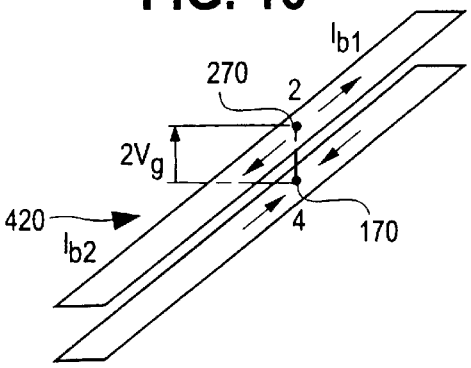
FIG. 16 is a simplified electrical schematic diagram showing the current flow in the circuit of FIG. 15, taking into account that in the coupled microstrip line odd mode opposite currents flow on both upper and lower transmission lines, and zero-potential points in each circuit allow each side to be analyzed separately.

FIG. 16 is a simplified electrical schematic diagram 420 showing the current flow in the circuit of FIG. 15. The simplified analysis exploits the facts that in the coupled microstrip line odd mode, opposite currents flow on both upper and lower transmission lines 416 and 418, and zero-potential points in each circuit allow each side to be analyzed separately. The coupled microstrip odd mode currents is are given by $I_{b1}=2V_gY_{b1}$ and $I_{b2}=2V_gY_{b2}$, where $Y_{b1}$ and $Y_{b2}$ are the input admittances due to the coupled microstrip odd mode. The total current is $I_b=I_{b1}+I_{b2}=2V_gY_b$. When odd excitation is applied to the equivalent circuit in FIG. 10, the input current is readily found to be given by $2V_g(Y_A+Y_B)$ and must equal $2V_gY_b$. From this relation, and the previous one ($Y_A=Y_a$), it is found that $$Y_B = Y_b - Y_a \quad \text{and} \quad Z_B = \frac{1}{Y_b - Y_a}.$$

Figure 17:
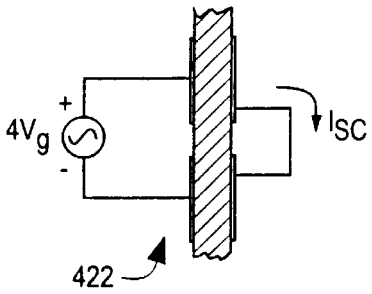
FIG. 17 is a simplified diagram showing the operation of the coupler with a generator connected to the input port and a load impedance connected to the output port.

By superimposing the solutions for mode a (FIGS. 12–13) and mode b (FIGS. 14–16), the equivalent circuit 422 of FIG. 17 is obtained. FIG. 17 is a simplified diagram showing the operation of the coupler with a generator connected to the input port and a zero impedance load (short circuit) connected to the output port. The input is driven by a generator with voltage $4V_g$. The output has zero voltage across the slot and short circuit current $(I_b)-(I_a)=2V_g(Y_b-Y_a)$ where $Y_b=Y_{b1}+Y_{b2}$ and $Y_a=Y_{a1}+Y_{a2}$. In the equivalent circuit in FIG. 10, the output short circuit current is $2V_gY_B$ and equals $2V_g(Y_b-Y_a)$. The admittance $Y_a$ is associated with the coupled co-planar strip line mode. The admittance $Y_b$ is associated with the coupled microstrip line odd mode. When the structure has some asymmetry and is driven in an unbalanced way, it is also possible to excite both the coupled microstrip line even mode and the antenna mode, but neither of these two modes have an electric field and voltage across the gap between strips on the input and output sides. Accordingly, neither of these two modes contribute to coupling through the glass 114 or another dielectric material to which the coupler may be directed.

When a finite load impedance is connected across the output terminals, with a generator on the input side, the only difference in the circuit operation is that the amplitudes of the coupled co-planar strip line mode and the coupled microstrip line odd mode will no longer be equal. The analysis carried out has identified how to find the equivalent circuit parameters $Z_A$ and $Z_B$ in the circuit representing the coupler (see FIGS. 10*a*–10*b*). $Z_A$ and $Z_B$ are given by $$Z_A = \frac{1}{Y_a}$$

and $$Z_B = \frac{1}{Y_b - Y_a}.$$

Figure 18:
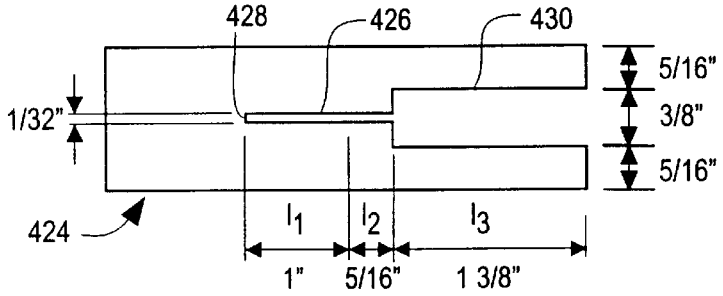
FIG. 18 is a plan view of a simplified transmission line structure to be used to model the behavior of the through-the-glass coupler of FIGS. 1–5 and 9.

FIG. 18 is a plan view of a simplified transmission line structure 424 to be used to model the behavior of the coupler 110 of present invention. The admittance $Y_a$ must be replaced by the transmission line admittance seen across the gap. The admittance $Y_b$ must be replaced by the transmission line admittance seen between conductors on the opposite sides of the dielectric. These admittances depend on the characteristics of the transmission lines and how they are terminated. The width and spacing of the conducting strips, the termination of the transmission lines on each side in open circuits or short circuits, and the lengths of the transmission lines, are chosen so as to obtain impedance matching between the signal source and the load impedance (antenna) at two (or more) different frequencies.

The structure 424 which is analyzed in the following discussion is the same as the coupler 110 of FIGS. 1–5, with the exception that the narrow slot 426 is centered about the longitudinal axis of the transmission line. This modification simplifies the analysis, but it is believed that the change has a negligible effect on the results. The analysis of this simplified model was undertaken to verify that the principles of operation described above apply to the dual-band coupler 110. The glass thickness is taken as 5/32 in, and the dielectric constant is taken as 7. Because the electric field is partly in air and partly in the dielectric, the effective dielectric constants range between 1 and 7, depending on the mode and the transmission line segment being considered. The effective dielectric constants, mode characteristic impedances, and effective wavelengths were found using well known formulas for microwave lines.

The electrical length of a line in radians is $2\pi l/\lambda_e$, where l is the physical length and $\lambda_e$ is the effective wavelength equal to the free-space wavelength $\lambda_0$ (13.12 in at 900 MHz) divided by the square root of the effective dielectric constant, $\sqrt{\epsilon_e}$. End effects may be estimated and used to modify the line length somewhat from their physical length.

Figure 19:
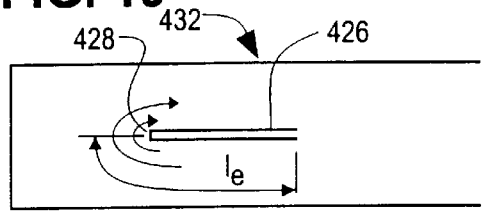
FIG. 19 is a plan view of a portion of the simplified transmission line structure of FIG. 18, illustrating how the behavior of the narrow slot portion thereof may be modeled when operating in the co-planar strip line mode.
Figure 20:
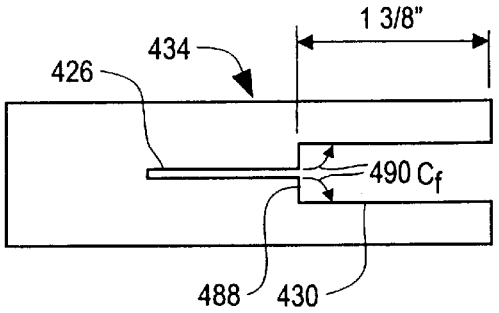
FIG. 20 is a plan view of a portion of the simplified transmission line structure of FIG. 18, illustrating how the behavior of the wide slot portion thereof may be modeled when operating in the co-planar strip line mode.

FIGS. 19 and 20 are directed to modeling the behavior of the coupler transmission lines in the coupled co-planer strip line mode, in which the upper and lower transmission lines are analyzed in parallel. FIG. 19 is a plan view of a portion 432 of the simplified transmission line structure 424 of FIG. 18, illustrating how the behavior of the narrow slot portion thereof 426 may be modeled when operating in the coupled co-planar strip line mode. The following calculated values may be used to model the structure: $\epsilon_e$=3.07; $\lambda_e$=7.49 in (900 MHz); and $Z_c$=91Ω. l=1 in corresponds to 480 or 0.84 radians. The narrow slot portion 426 appears longer because current flows around the corner 428, following a longer path. Accordingly, the length l is preferably increased by an estimated 0.12 in, to give an electrical length of 0.94 radians at 900 MHz.

FIG. 20 is a plan view of a portion 434 of the simplified transmission line structure 424 of FIG. 18, illustrating how the behavior of the wide slot portion thereof 430 may be modeled when operating in the co-planar strip line mode. The following calculated values may be used to model the structure: $\epsilon_e$=2.15; $\lambda_e$=8.95 in (900 MHz); and $Z_c$=280Ω. Fringing capacitance 490 ($C_f$) of 0.22 pF (−j800Ω in shunt at 900 MHz) is preferably added at the step junction 488. The electrical length of the 1⅜ in line is 0.965 radians at 900 MHz.

Figure 21:
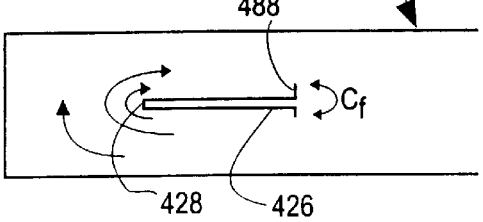
FIG. 21 is a plan view of a portion of the simplified transmission line structure of FIG. 18, illustrating how the behavior of the narrow slot portion thereof may be modeled when operating in the coupled microstrip line odd mode.
Figure 22:
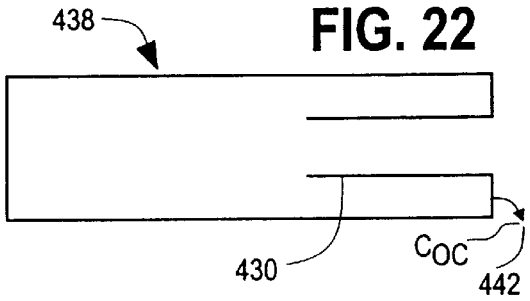
FIG. 22 is a plan view of a portion of the simplified transmission line structure of FIG. 18, illustrating how the behavior of the wide slot portion thereof may be modeled when operating in the coupled microstrip line odd mode.

FIGS. 21 and 22 are directed to modeling the behavior of the coupler transmission lines in the coupled microstrip line odd mode. FIG. 21 is a plan view of a portion 436 of the simplified transmission line structure 424 of FIG. 18, illustrating how the behavior of the narrow slot portion 426 thereof may be modeled when operating in the coupled microstrip line odd mode. The following calculated values may be used to model the structure: $\epsilon_e$=5.22; $\lambda_e$=5.74 in (900 MHz); and $Z_c$=31Ω. l=1 in corresponds to an electrical length of 62.7° or 1.095 radians. This length is preferably increased by an estimated 0.37 in, since current in this mode will spread further beyond the shorted end 428 of the narrow slot 426, resulting in an electrical length of 1.5 radians at 900 MHz. A fringing capacitance 440 ($C_f$) of 0.22 pF is preferably added at the step junction 488.

FIG. 22 is a plan view of a portion 438 of the simplified transmission line structure 424 of FIG. 18, illustrating how the behavior of the wide slot portion thereof 430 may be modeled when operating in the coupled microstrip line odd mode. The following calculated values may be used to model the structure: $\epsilon_e$=5.5; $\lambda_e$=5.59 in (900 MHz); and $Z_c$=49Ω. The 1⅜ in line has an electrical length of 88.5° or 1.54 radians. This length is preferably increased to 1.64 radians to account for the open-circuit end capacitance 442 ($C_{oc}$) between the upper and lower strips.

Figure 23:
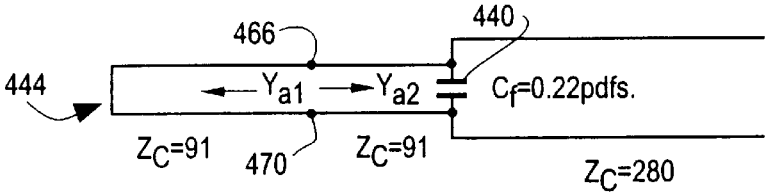
FIG. 23 is a schematic diagram of an electrical circuit equivalent to the transmission line structure of FIGS. 18–20, operating in the co-planar strip line mode.

FIG. 23 is a schematic diagram of an electrical circuit 444 equivalent to the transmission line structure 424 of FIGS. 18–20, operating in the co-planar strip line mode. Circuit 444 is used to derive the following:

$$jX_1 = \frac{1}{Y_{a1}};\ jX_4 = \frac{1}{Y_{a2}};$$

and $$jX_a = \frac{1}{Y_{a1} + Y_{a2}} = jX_A.$$

Figure 24:
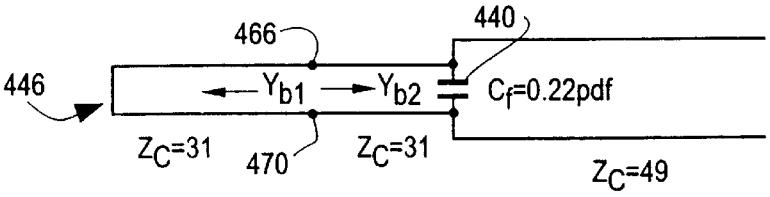
FIG. 24 is a schematic diagram of an electrical circuit equivalent to the transmission line structure of FIGS. 18, 21, and 22, operating in the coupled microstrip line odd mode.

FIG. 24 is a schematic diagram of an electrical circuit 446 equivalent to the transmission line structure 424 of FIGS. 18, 21, and 22, operating in the coupled microstrip line odd mode. Circuit 446 is used to derive the following:

$$jX_B1 = \frac{1}{Y_{b1}};\ jX_B5 = \frac{1}{Y_{b2}};\ jX_b = \frac{1}{Y_{b1} + Y_{b2}};\ jX_B = \frac{1}{Y_b - Y_a} = j\frac{X_a X_b}{X_a - X_b}.$$

With the analysis described above, the performance of the model of the dual-band coupler 110 was found to be substantially in accord with a prototype embodiment of the dual band coupler 110 described herein, with the exception that the model predicted a VSWR somewhat greater than 1.5 in the PCS frequency band and a smaller insertion loss than that measured in the frequency range between the two bands. The input-normalized resistance and reactance and the VSWR, which were predicted by the model, are shown graphically in FIG. 25 and in tabular form in FIGS. 26–27 and 29. The model analyzed neglected the offset of the narrow slot from the longitudinal axis, and did not take into account the laminations or the dielectric loss in the glass. Estimated values were used for the relative dielectric constant of the glass, and the end effect for the transmission lines. The formulas used to calculate the characteristic impedances and the effective dielectric constants for the various transmission line modes are believed to be accurate to within a few percent, but even small inaccuracies would account for some difference between the calculated and measured results.

Figure 25:
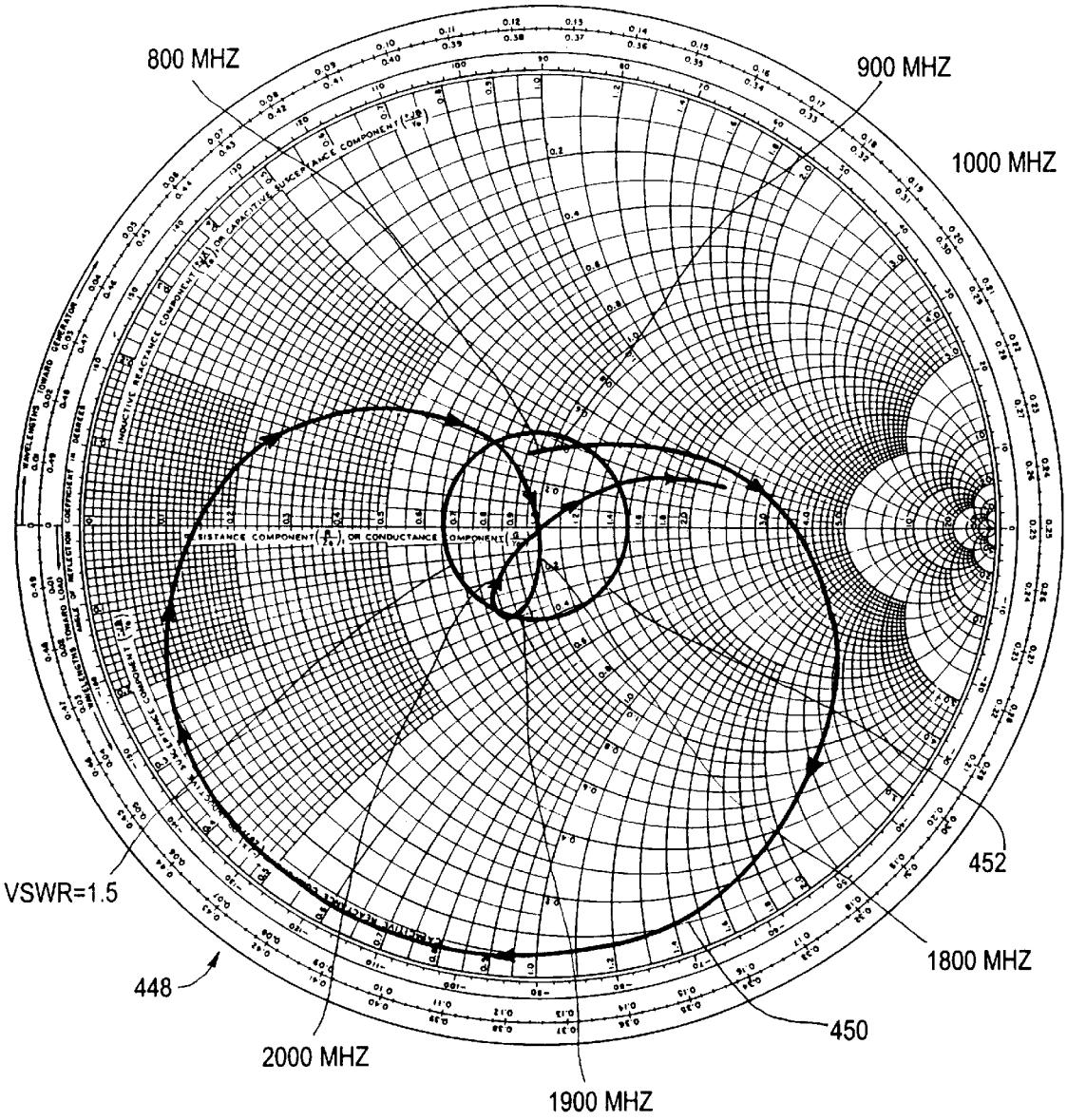
FIG. 25 is a Smith chart plot of the input impedance at selected frequencies of the through-the-glass coupler as modeled according to the transmission line structures and circuits of FIGS. 18–24.

In order to harmonize the calculated results with the measured results, the model which was quantitatively analyzed to produce the results of FIGS. 25–27 incorporated one change to a parameter derived from the physical dimensions of the coupler. This change was the reduction of the electrical length of the transmission line representing the coupled co-planar strip line mode in the wide slot region from 0.965 radians (as calculated from physical dimensions; see FIG. 20) to 0.9 radians at 900 MHz. This one change brought the calculated VSWR in both the cellular and PCS frequency bands to the desired value of 1.5:1 or less. The predicted performance of a dual-band coupler 110, is shown in FIG. 29.

FIG. 25 is a Smith chart 448 showing a plot 450 of the predicted input impedance of the through-the-glass coupler, at selected frequencies. Circle 452 corresponds to a voltage standing wave ratio (VSWR) of 1.5:1; the region within the circle 452 corresponds to VSWRs below 1.5:1, representing an acceptable impedance match. The Smith chart plot 450 remains near the origin of the chart, and within the circle 450, throughout the 824 to 894 MHz cellular frequency band. At frequencies above the cellular frequency band but below the PCS frequency band the plot deviates widely from the origin, indicating that the impedance match is poor at those frequencies. Within the 1850 to 1990 MHz PCS frequency band, the Smith chart plot 450 returns to the region near the origin of the chart and within the circle 450. Thus, in both the cellular and PCS frequency bands, the performance of the coupler, as predicted by the model described above, is excellent.

At frequencies approximately midway between the cellular and PCS bands, the VSWR reaches a peak value of 54.89, which corresponds to an insertion loss; of 11.5 dB. The measured insertion loss shown in FIG. 8*b* was somewhat larger than 14 dB. Overall, the agreement between measured and predicted values is considered to be very good, in view of the limitations involved in the analyzed model. In particular, it is believed that circuit losses, which were neglected in the model, would have increased the predicted insertion loss had their effects been included in the calculations.

FIG. 26 is a table 454 showing the calculated input resistance, input reactance, and voltage standing wave ratio (VSWR), at selected frequencies, of the through-the-glass coupler, according to the model described above. FIG. 27 is a table 456 showing key reactances $X_A$ and $X_B$, and corresponding VSWRs, used in analysis of the circuits of FIGS. 23 and 24 at selected frequencies. FIG. 28 is a listing 460 of a computer program for calculating the resistance, reactance, and VSWR values tabulated in FIGS. 26 and 27. The table of FIG. 27 shows that the obtained pairs of values for the reactances $X_A$ and $X_B$ provide good impedance matching in both the cellular and PCS frequency bands. It is believed that the analysis presented has established the operating principles of the dual-band coupler 110, and the calculated numerical results have verified the correctness of those operating principles.

The predicted performance of a dual-band coupler 110, including the input-normalized resistance and reactance and the VSWR, calculated according to the model, and using a wide slot region transmission line length of 0.965 radians, is shown in FIG. 29.

FIGS. 30(*a*)–(*e*) are exemplary alternate configurations for the transmission lines of the through-the-glass coupler. The transmission lines and the way they are terminated must be designed so as to obtain a suitable pair of values for $X_A$ and $X_B$ to provide impedance matching at two or more frequencies. Steps in characteristic impedance (such as step changes in conductor widths or spacing) will effect how the transmission line transforms an open circuit or short circuit impedance into an $X_A$ or $X_B$ as a function of frequency. As best seen in FIG. 30(*a*), the transmission lines 482*a* may employ a single impedance step. As best seen in FIG. 30(*b*), the transmission lines 482*b* could also employ two impedance steps. As best seen in FIG. 30(*c*), the transmission lines 482*c* could also employ shunt capacitive loading in the form of a short stub. Alternatively, as best seen in FIG. 30(*d*), the transmission lines 482*d* could employ shunt inductive loading in the form of notches. As best seen in FIG. 30(*e*), the transmission lines 482*e* could also employ a taper. Moreover, the taper may be combined with a step. Such modifications or alternatives may be employed to alter the impedance transforming properties of the transmission lines. These and other microstrip techniques are well known in the microwave field. One of ordinary skill will appreciate how such modifications of the coupler 110 may be applied consistent with the spirit of the present invention.

Figure 31:
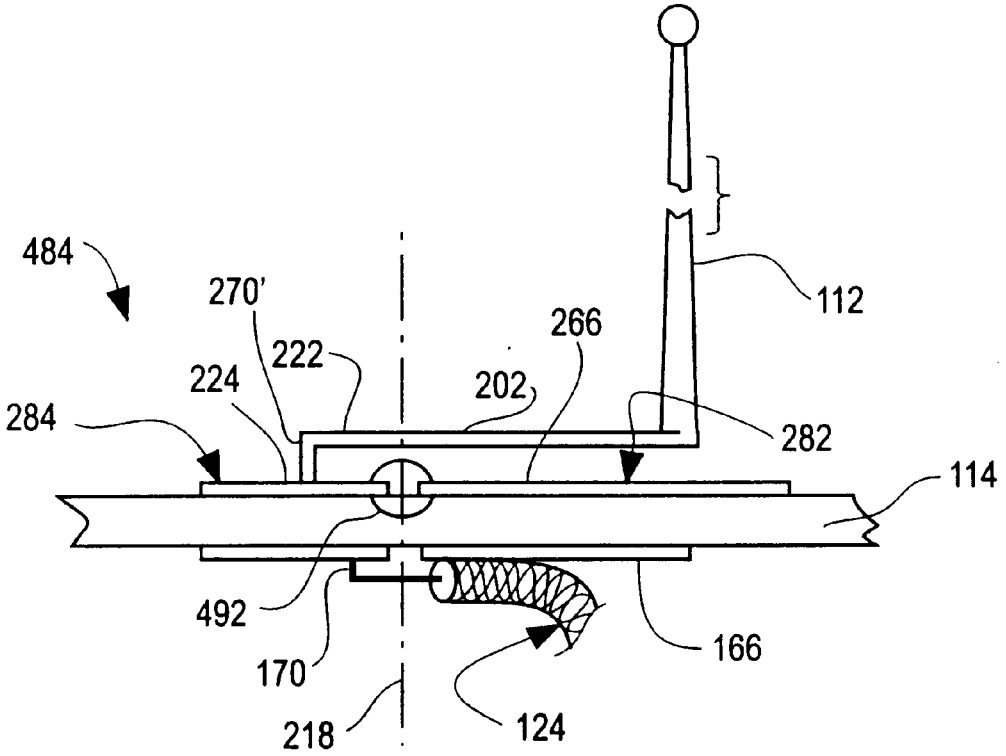
FIG. 31 is a simplified cross section diagram of the antenna system showing the arrangement of the through-the-glass coupler, the radiator, and a microstrip line section used to match the impedance of the radiator to that of the coupler, taken along view lines 31—31 of FIG. 4.
Figure 32:
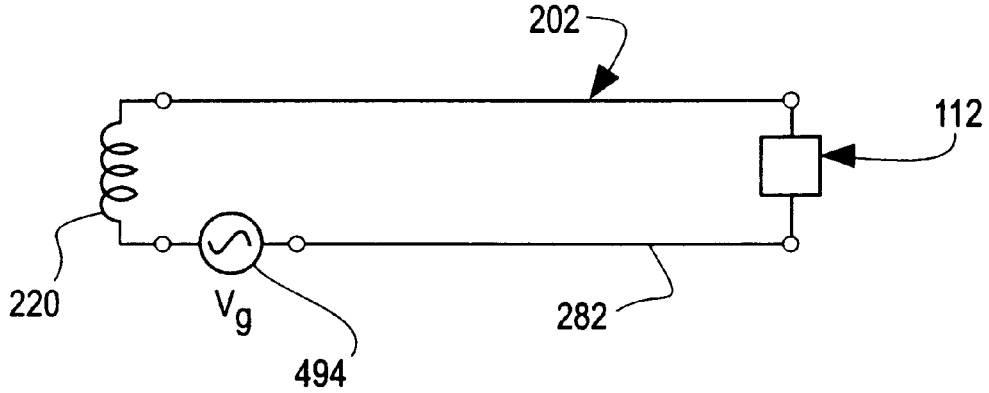
FIG. 32 is an electrical schematic diagram of an equivalent circuit including only that portion of the antenna system extending from the output port of the coupler through the radiator.

FIG. 31 is a simplified cross section diagram 484 of the antenna system showing the arrangement of the through-the-glass coupler 110, the radiator 112, and a microstrip line section (including conductor 202) used to match the impedance of the radiator 112 to that of the coupler 110. FIG. 32 is an electrical schematic diagram of an equivalent circuit 486 including only that portion of the antenna system extending from the output port of the coupler 110 through the radiator. A broken vertical line designated 218 bisects CEP narrow slot region 262 in an area 492 near CEP first and second connection points 270 and 266. The electric field across the slot at 492 acts as a series voltage source $V_g$ 494 to drive the antenna transmission line, which comprises a single conductor 202 over the conducting segments 282 and 284. Segments 282 and 284 act as a ground plane. The transmission line conductor 202 is connected to conducting segment 284, and therefore to the ground plane, at the connection point 270. Accordingly, the portion 222 of conductor 202 to the left of line 218, and the portion 224 of conducting segment 284 to the left of line 218, form a shorted transmission line section. The relatively short length of the shorted transmission line section behaves as an inductor in series with the equivalent voltage source 494 represented by the electric field across the narrow slot. This series inductance is shown in the equivalent circuit of FIG. 32 as inductor 220. This inductance is relatively unimportant at cellular frequencies but becomes a more significant part of the antenna matching network at PCS frequencies.

The above-described embodiments of the invention are merely examples of ways in which the invention may be carried out. Other ways may also be possible, and are within the scope of the following claims defining the invention.

What is claimed is:

1. An antenna device for use in conjunction with a dielectric material having a first surface and a second surface comprising:

a substantially planar first energy coupling means adapted for non-penetrating application to the first surface;

said first energy coupling means comprising a first electrical energy connection port and first and second dissimilar planar transmission line segments, said first and second transmission line segments abutting one another, and extending in generally opposite directions from said connection port;

a substantially planar second energy coupling means comprising a mirror image of the said first energy coupling means adapted for non-penetrating application to the second surface; and an antenna radiating element electrically connected to said second energy coupling means;

whereby with said first energy coupling means placed against the first surface of the dielectric material, and the second energy coupling means placed against the second surface of the dielectric material, said first and second energy coupling means cooperate to couple electrical energy through the dielectric material between said first electrical energy connection port and said antenna radiating element, said antenna device being operable in at least two disparate frequency bands greater than 800 MHz, and separated by a ratio of approximately of 2:1.

2. The antenna device of claim 1, wherein:

the first transmission line segment of both coupling means comprises a two element co-planar parallel conductor configuration having a first end and an open circuited second end, the first transmission line section having a finite conductor width and spacing geometry;

the second transmission line segment of both coupling means comprising a slotted planar conductive sheet having a first edge contiguous with the first end of said first transmission line section near said energy coupling port, and a second edge opposite said first edge, said slot extending from said first edge toward said second edge and defining a two element co-planar parallel conductor configuration and forming a short circuit at said second edge;

the first transmission line section having a characteristic impedance greater than the second transmission line section.

3. The antenna device of claim 2, further comprising:

means for exciting a coupled microstrip line odd mode among said transmission line segments.

4. The antenna device of claim 2, further comprising:

means for exciting the coupled co-planar strip line mode among said first and second transmission line segments of the first energy coupling means.

5. The antenna device of claim 1, further comprising:

means for exciting a coupled microstrip line odd mode among the transmission line segments comprising said first and second energy coupling means.

6. The antenna device of claim 1, further comprising:

means for exciting the coupled co-planar strip line mode among said first and second transmission line segments of the second energy coupling means.

7. The antenna device of claim 1 wherein said at least two disparate frequency bands comprise a first frequency band including the frequency range 824 to 894 MHz and a second frequency band including the frequency range 1850 to 1990 MHz.

8. The antenna device of claim 1 wherein said first and second coupling means are configured to provide a characteristic impedance at the connection port of the first coupling means within a predetermined impedance range throughout a first frequency band of 824 to 894 MHz and a second frequency band of 1850 to 1990 MHz.

9. The antenna device of claim 1 wherein said first coupling means comprises:

a substantially planar conductive sheet member having a longitudinal axis and at least a first peripheral edge extending in a direction transverse to the longitudinal axis;

said sheet member having a slot extending inward from said first edge;

said slot defining first and second conductor elements for each of said first and second transmission line segments on opposite sides of said slot.

10. The antenna device of claim 9 wherein said slot has a width measurable in a direction transverse to said longitudinal axis, and said slot comprises a first segment having a selected width and a second segment having a width smaller than said selected width.

11. The antenna device of claim 9 wherein said first and second transmission line segments of said first coupling means are capable of cooperating with said transmission line segments of said second energy coupling means to support on said transmission line segments a coupled co-planar strip line mode.

12. The antenna device of claim 9 wherein said first and second transmission line segments of said first coupling means are capable cooperating with said first and second transmission lines of said second energy coupling means for supporting a coupled microstrip line odd mode.

13. The antenna device of claim 9, further comprising:

means for exciting a coupled microstrip line odd mode among said transmission line segments;

means for exciting a coupled coplanar strip line mode among said first and second transmission line segments of said first energy coupling means;

means for exciting a coupled co-planar strip line mode among said first and second transmission line segments of said second energy coupling means;

said transmission line segments cooperating to exhibit an impedance characteristic at said first connection port, said impedance characteristic lying within a predetermined impedance range over at least two disparate frequency bands greater than 800 MHz, separated by a ratio in the order of 2:1.

14. The antenna device of claim 13 wherein said at least two disparate frequency bands include the frequency range 824 to 894 MHz and the frequency range 1850 to 1990 MHz.

15. The antenna device of claim 9 wherein said first and second conductor elements are electrically shorted at a location near an end of said slot opposite said first edge.

16. The antenna device of claim 9 wherein said slot has a wide region adjacent said first edge and a narrow region adjacent an end of said slot opposite said first edge.

17. The antenna device of claim 9 wherein said electrical connection between said antenna radiating element and said second coupling means comprises a first connection point electrically connected to said first conductor element of said first and second transmission line segments of said second coupling means and a matching section conductor extending between said first connection point and said antenna radiating element;

said matching section conductor cooperating with said substantially planar sheet member of said second coupling means and operative in at least one of said at least two-frequency bands to form an impedance transforming transmission line.

18. The antenna device of claim 17 wherein said antenna radiating element comprises a lower radiating section, a dual frequency band phasing means connected to the lower radiating section, and an upper radiating section connected to said phasing means.

19. The antenna device of claim 18 wherein said phasing means comprises a helical coil, providing controlled phasing of radiator sections in said at least two disparate frequency bands greater than 800 MHz separated by a ratio in the order of 2:1.

20. The antenna device of claim 18 wherein said upper radiating section comprises:

a linear conductor extending from said phasing means and having a first end adjacent said phasing means and a second end; and choke means disposed at a position intermediate said first and second ends of said upper radiating section.

21. The antenna device of claim 20 wherein said choke means is operable in at least one of said frequency bands to minimize current flowing in a portion of said upper radiating section between said choke means and said second end.

22. The antenna device of claim 20 wherein said upper radiating section has an electrical length and said choke means is operable such that said electrical length at a first one of said frequency bands is approximately the same as said electrical length at a second one of said frequency bands.

23. The antenna device of claim 20 wherein said choke means comprises a substantially cylindrical sleeve surrounding a portion of said linear conductor and spaced radially therefrom.

24. The antenna device of claim 23 wherein said sleeve has a sleeve first end and a sleeve second end, said sleeve second end being electrically connected to said linear conductor.

25. The antenna device of claim 24 wherein said sleeve has an electrical length in a first one of said frequency bands of approximately one-quarter wavelength.

26. The antenna device of claim 18 wherein said phasing means is operative in at least two of said frequency bands to cause current flowing in said lower radiating section and said upper radiating section to maintain an in-phase relationship.

27. The antenna device of claim 17 wherein said radiating element comprises a linear element with an electrical length in the order of a quarter wave at the lower frequency band, and an electrical length in the order of one-half wave at the higher frequency band.

28. The antenna device of claim 9 wherein said electrical connection port comprises a first connection point electrically connected to said first conductor element of said first and second transmission line segments, and a second connection point electrically connected to second electrical conductor element of said first and second transmission line segments.

29. The apparatus of claim 1, wherein said antenna device operable in at least a first frequency band including the frequency range 824 to 894 MHz and a second frequency band including the frequency range 1850 to 1990 MHz.

30. A through-dielectric coupler adapted for use in conjunction with a dielectric material having a first surface and a second surface comprising:

a substantially planar first energy coupling means adapted for non-penetrating application to the first surface;

said first energy coupling means comprising a first electrical energy connection port, and two dissimilar, contiguous planar transmission line sections, each extending in mutually opposed directions from the energy connection port;

an essentially planar second energy coupling means adapted for non-penetrating application to the second surface;

said second energy coupling means comprising a mirror image of the first energy coupling means;

said second energy coupling means comprising a second electrical energy connection port;

said first and second energy coupling means cooperating to couple electrical energy between said first electrical energy connection port and said second electrical energy connection port through the dielectric material;

said coupler operable in at least two disparate frequency bands greater than 800 MHz, separated by a ratio in the order of 2:1.

31. The through dielectric coupler of claim 30, said coupler configured to operate in at least a first frequency band including the frequency range 824 to 894 MHz and a second frequency band including the frequency range 1850 to 1990 MHz.

32. An antenna adapted for use in conjunction with a dielectric panel having a first surface and a second surface, the antenna comprising:

a first electrical coupling portion adapted to be installed on the first surface of the dielectric panel;

a second electrical coupling portion adapted to be installed on the second surface of the dielectric panel at a location opposite the first electrical coupling portion;

said first electrical coupling portion comprising a first radio frequency energy connection port;

said a second electrical coupling portion comprising means for mechanically supporting a radio frequency antenna radiating member, said radio frequency antenna radiating member being electrically connected to said second electrical coupling portion;

said first and second electrical coupling portions each comprising a substantially planar conductive sheet defining first and second dissimilar co-planar transmission line segments on each of said first and second electrical coupling portions configured to support a microstrip line odd mode between the transmission line segments of said first and second electrical coupling portions, and a coupled co-planar strip line mode between the transmission line segments of each of the first and second electrical coupling portions, said transmission line segments establishing an electrical coupling through said dielectric panel for radio frequency energy between said first radio frequency energy connection port and said radio frequency antenna radiating member;

said first and second electrical coupling portions and said radio frequency antenna radiating member being operable and at least two disparate frequency dance greater than 800 MHz, separated by a ratio in the quarter of 2:1.

33. The antenna of claim 32 wherein:

said substantially planar conductive sheets of said first and second electrical coupling portions each have an inner surface and an outer surface, said inner surface being oriented to face the dielectric panel; and said first and second electrical coupling portions further comprises an inner substantially planar insulating film layer and an outer substantially planar insulating film layer, said inner film layer being disposed adjacent said inner surface of said substantially planar conductive sheet and said outer film layer being disposed adjacent said outer surface of said substantially planar conductive sheet.

34. The antenna of claim 32 further comprising means for securing said second coupling portion to the second surface of the dielectric panel.

35. The antenna of claim 34 wherein said means for securing said second coupling portion to the second surface of the dielectric panel comprises a substantially planar adhesive layer.

36. The antenna of claim 32 wherein said second coupling portion is positioned to function as a counterpoise in at least one of said frequency bands.

37. The antenna of claim 32 wherein said first coupling portion is positioned to function as a counterpoise in at least one of said frequency bands.

38. The antenna of claim 32 wherein said second coupling portion further comprises a counterpoise extension electrically connected to said substantially planar conductive sheet of said second coupling portion.

39. The antenna of claim 32 wherein said antenna radiating element comprises a lower radiating section, a dual frequency band phasing means connected to the lower radiating section, and an upper radiating section, said upper radiating section functioning as a half-wave radiator in each of said frequency bands.

40. A dual-band antenna radiating element comprising:

a radio-frequency energy connection port;

a lower radiating section;

means for electrically coupling said radio-frequency energy connection port to said lower radiating section;

a dual frequency band phasing means connected to said lower radiating section;

and an upper radiating section connected to said phasing means;

said antenna radiating element being operable in at least two disparate frequency bands greater than 800 MHz, separated by a ratio in the order of 2:1.

41. The dual-band antenna radiating element of claim 40 wherein said means for electrically coupling said radio-frequency energy connection port to said lower radiating section comprises:

a matching section conductor extending between said radio-frequency energy connection port to said lower radiating section; and a substantially planar conductive segment disposed in proximity to said matching section conductor;

said matching section conductor cooperating with said substantially planar conductive segment and operative in at least one of said frequency bands to form an impedance transforming transmission line.

42. The dual-band antenna radiating element of claim 40 wherein said upper radiating section functions as a half-wave radiator in each of said frequency bands.

43. The dual-band antenna radiating element of claim 40 wherein said upper radiating section comprises:

a linear conductor extending from said phasing means and having a first end adjacent said phasing means and a second end; and choke means disposed at a position intermediate said first and second ends of said upper radiating section.

44. The dual-band antenna radiating element of claim 43 wherein said choke means is operable in at least one of said frequency bands to minimize current flowing in a portion of said upper radiating section between said choke means and said second end.

45. The dual-band antenna radiating element of claim 43 wherein said upper radiating section has an electrical length and said choke means is operable such that said electrical length at a first one of said frequency bands is approximately the same as said electrical length at a second one of said frequency bands.

46. The dual-band antenna radiating element of claim 43 wherein said choke means comprises a substantially cylindrical sleeve surrounding a portion of said linear conductor and spaced radially therefrom.

47. The dual-band antenna radiating element of claim 46 wherein said sleeve has a sleeve first end and a sleeve second end, said sleeve second end being electrically connected to said linear conductor.

48. The dual-band antenna radiating element of claim 47 wherein said sleeve has an electrical length in a first one of said frequency bands of approximately one-quarter wavelength.

49. The dual-band antenna radiating element of claim 40 wherein said phasing means comprises a helical coil providing controlled phasing of current flowing in both said upper and lower radiating sections in two disparate frequency bands greater than 800 MHz, separated by a ratio in the order of 2:1.

50. The dual-band antenna radiating element of claim 49 wherein said phasing means is operative in at least two of said frequency bands to cause current flowing in said lower radiating section and said upper radiating section to maintain an in-phase relationship.

* * * * *